US010599078B2

(12) United States Patent
Ota et al.

(10) Patent No.: US 10,599,078 B2
(45) Date of Patent: Mar. 24, 2020

(54) MEDIUM PROCESSING APPARATUS, AND METHOD OF CONTROLLING THE MEDIUM PROCESSING APPARATUS

(71) Applicant: SEIKO EPSON CORPORATION, Tokyo (JP)

(72) Inventors: Miho Ota, Shiojiri (JP); Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/207,365

(22) Filed: Dec. 3, 2018

(65) Prior Publication Data

US 2019/0171135 A1 Jun. 6, 2019

(30) Foreign Application Priority Data

Dec. 4, 2017 (JP) ..... 2017-232755

(51) Int. Cl.
*G03G 15/20* (2006.01)
*B41J 15/04* (2006.01)
*B41J 11/00* (2006.01)

(52) U.S. Cl.
CPC ..... *G03G 15/205* (2013.01); *B41J 11/002* (2013.01); *B41J 15/046* (2013.01); *G03G 2215/2045* (2013.01)

(58) Field of Classification Search
CPC .... B41M 7/009; B41J 2/04515; B41J 11/002; B41J 15/046; G03G 15/205; G03G 15/2007; G03G 15/201; G03G 2215/2045
See application file for complete search history.

(56) References Cited

U.S. PATENT DOCUMENTS 6,297,841 B1 * 10/2001 Takeda ..... B41J 2/365 347/186
2003/0161552 A1 * 8/2003 Shima ..... B41J 11/002 382/312
2008/0304850 A1 * 12/2008 Groninger ..... B41J 29/393 399/88
2011/0036255 A1 * 2/2011 Monclus ..... B41J 11/002 101/424.1
2015/0202893 A1 * 7/2015 Hara ..... B41J 11/0095 347/16
2016/0214378 A1 7/2016 Yoshida et al.
2018/0072070 A1 * 3/2018 Matoba ..... B41J 2/2132

FOREIGN PATENT DOCUMENTS

JP 2006-192779 A 7/2006
JP 2016-137604 A 8/2016
JP 2016-137605 A 8/2016

* cited by examiner

*Primary Examiner* — Carla J Therrien
(74) *Attorney, Agent, or Firm* — Workman Nydegger

(57) ABSTRACT

Provided is a medium processing apparatus, comprising: transport unit configured to transport a medium, a drying device configured to heat the medium, a temperature sensor configured to detect a surface temperature of the medium in a heated area, the heated area being heated by the drying device, and a control unit configured to control the drying device based on the surface temperature detected by the temperature sensor. The control unit start a warm-up operation controlling the heating unit to increase the surface temperature of the medium to a predefined temperature range, and controls transport of the medium during the warm-up operation so that the medium is within a predefined range where the medium is located in a detection area of the temperature sensor.

10 Claims, 6 Drawing Sheets

MEDIUM PROCESSING APPARATUS, AND METHOD OF CONTROLLING THE MEDIUM PROCESSING APPARATUS

BACKGROUND

1. Technical Field

The disclosure relates to a medium processing apparatus configured to perform processing such as drying by heating a medium, and a method of controlling the medium processing apparatus.

2. Related Art

For example, JP-A-2006-192779, JP-A-2016-137604, and JP-A-2016-137605 disclose a printing apparatus for discharging liquid such as ink onto a medium such as paper to perform printing. This printing apparatus includes a medium processing apparatus including a drying device (an example of a heating unit) for applying heat treatment such as heating to a printed medium to be dried. If the printed medium is carried into a drying device in a state where the drying device has not reached the target temperature, the medium loses its printing quality when the printing surface is scratched due to an insufficient drying. For this reason, a heat generating element such as a drying device needs a warm-up operation in which the drying device is heated in advance to the target temperature before a predefined process such as printing process is started.

For example, JP-A-2016-137604 discloses a liquid ejecting apparatus including a heating mechanism (an example of a heating unit) for heating a medium from the front side, where there is known a configuration for controlling the temperature of the heating unit based on a detection result of an IR sensor having detected the surface temperature (e.g., paper surface temperature) to bring the surface of the medium into a heated state at a predefined temperature.

SUMMARY

Unfortunately, at the stage before printing, the heating of the drying device is carried out in a state where there is no medium inside the drying device, thus, a temperature sensor such as an IR sensor is to detect a support surface (transport surface) on which no medium is placed yet. However, since the support surface is made of a material (metal or the like) different from the material (paper or the like) of the medium and has different radiation rate than the medium, the temperature of the heating unit, which is controlled based on the surface temperature of the support surface, may be different from the temperature suitable for the medium. As a result, there is a concern that, for example, drying of the medium becomes insufficient and the medium suffers from an excessive thermal damage depending on the material of the support surface. Accordingly, a temperature control of the heating mechanism is required by detecting the surface temperature of the medium with a temperature sensor.

However, if the same portion of the medium continues to be heated for a relatively long time until the heating unit reaches the target temperature taking time for the warm-up operation in which the output of the heating unit is increased prior to the predefined process while the temperature of the heating unit is controlled until reaching the target temperature, the medium is damaged due to thermal damage, and thus the medium used for the warm-up operation cannot be reused for the printing and is then to be discarded as a waste paper, for example. In the meantime, in such type of medium processing apparatus, there is a demand to reduce or eliminate the discarded portions of the medium.

An object of the exemplary embodiment described below is to provide a medium processing apparatus and a method of controlling the medium processing apparatus, in which during the warm-up operation of increasing an output of a heating unit to a temperature suitable for heating the medium, a control of the temperature of the heating unit based on the surface temperature of the medium is properly performed while preventing a damage to the medium used as a target to be heated due to thermal damage.

According to one embodiment, a medium processing apparatus includes: a transport unit configured to transport a medium, a heating unit configured to heat the medium, a temperature sensor configured to detect a surface temperature of the medium in a heated area, the heated area being an area heated by the heating unit, and a control unit configured to control the heating unit based on the surface temperature detected by the temperature sensor, wherein the control unit is configured to start a warm-up operation controlling the heating unit to increase the surface temperature of the medium to a predefined temperature range, and to control transport of the medium during the warm-up operation so that a downstream end portion of the medium is within a predefined range where the medium is located in a detection area of the temperature sensor.

In the above embodiment, during the warm-up operation of increasing the output of the heating unit to a temperature suitable for heating the medium, the temperature of the heating unit can be properly controlled based on the surface temperature of the medium while preventing a damage to the medium used as a target to be heated due to thermal damage.

In a medium processing apparatus according to another embodiment, the control unit may be configured to start the warm-up operation upon receiving a process command for instructing a predefined process, to terminate the warm-up operation upon detecting that the surface temperature of the medium is increased to the predefined temperature range, and to start the predefined process.

In the above embodiment, the user, by giving an instruction of the predefined process, allows the warm-up operation to be started by the control unit having received the process command. The control unit controls the temperature of the heating unit to increase the surface temperature of the medium to the predefined temperature range, and then terminates the warm-up operation to start the predefined process. This allows the user, by giving an instruction of the predefined process, to cause the control unit to start the predefined process for the medium after the heating unit becomes capable of heating the medium to make the surface temperature of the medium in a suitable predefined temperature range.

In a medium processing apparatus according to another embodiment, transport of the medium during the warm-up operation may include transport of the medium at a speed corresponding to a transport speed of the medium during the predefined process.

In the above embodiment, since the warm-up operation includes a transport of the medium at a speed corresponding to the transport speed of the medium in the predefined process subsequently performed, the heating unit can heat the surface of the medium to a suitable temperature when the predefined process is performed. Accordingly, the accuracy of the surface temperature of the medium is improved regardless of the transport speed of the medium during the predefined process, and thus the medium can be properly dried.

In a medium processing apparatus according to another embodiment, the control unit may be configured to cause a downstream end portion on the downstream side of the medium to be transported further upstream than the heated area, after the termination of the warm-up operation, in a state where maintaining the output of the heating unit within a predetermined range, and to start the predefined process after the transport the downstream end portion of the medium further upstream than the heated area is terminated.

In the above embodiment, even if the end portion on the downstream side of a medium is transported upstream side of the heated area and then the medium retreats from the detection area of the temperature sensor after the termination of the warm-up operation, the output of the heating unit is maintained within the predetermined range. This prevents a malfunction of the heating unit due to an improper temperature control of the heating unit by the sensor based on a surface temperature of, for example, a support surface (transport surface) other than the medium.

In a medium processing apparatus according to another embodiment, the control unit may be configured to control transport of the medium during the warm-up operation when surface temperature of the medium detected by the temperature sensor is higher than or equal to specific temperature, the specific temperature being lower than the predefined temperature range.

In the above embodiment, even if the medium is heated by the heating unit, the medium is not transported during the warm-up operation until the medium surface temperature reaches the specific temperature, while the medium is transported after the medium surface temperature reached the specific temperature. Accordingly, the transport amount of the medium during the warm-up operation can be reduced, contributing to power saving. In the above case, since a transport start timing of the medium is determined based on the detection temperature (actual temperature) that is independent of the external environment, an improper transport start timing that is too early or too late can be avoided, achieving a sufficient power saving effect and a temperature control with high accuracy compared to the configuration in which the transport start timing of the medium is determined by a standby time, for example.

In a medium processing apparatus according to another embodiment, the control unit may be configured to control transport of the medium during the warm-up operation after a lapse of a predefined time from the start of the warm-up operation.

In the above embodiment, before the lapse of a predefined time from the start of the warm-up operation, the medium is not transported during the warm-up operation, while after the lapse of a predefined time, the medium is transported during the warm-up operation. Accordingly, the transport amount of the medium during the warm-up operation can be reduced, contributing to power saving.

In a medium processing apparatus according to another embodiment, the control unit may be configured to control transport downstream and transport upstream as transport of the medium during the warm-up operation, the direction of the transport upstream being opposite to the direction of the transport downstream.

In the above embodiment, since the transport toward a downstream side and the transport toward an upstream side of the medium are performed during the warm-up operation, the portion to be heated by the heating unit in the medium transported during the warm-up operation can be relatively shortened. Further, the transport amount (e.g., cue transport amount) of the medium transported toward the upstream side to the start position of the predefined process after the termination of the warm-up operation can be relatively shortened in more assured manner due to the inclusion of the transport toward an upstream side. Accordingly, the average waiting time from the termination of the warm-up operation to the time when the predefined process is started can be relatively shortened. This contributes to an improvement of the throughput of the predefined process.

In a medium processing apparatus according to another embodiment, second transport speed at the transport downstream may be greater than first transport speed at the transport upstream.

In the above embodiment, in the transport of the medium toward the upstream side, the medium is transported at the second transport speed that is greater than the first transport speed at which the medium is transported to the downstream side. For this reason, even if an area just moved to the outside of the heated area in the transport of the medium toward the downstream side enters the heated area immediately after the transport toward a downstream side is switched to the transport toward an upstream side, the medium is then transported toward the upstream side at the second transport speed that is greater than the first transport speed at which the medium is transported to the downstream side, preventing a damage to the area due to thermal damage received by the area on the medium.

In a medium processing apparatus according to another embodiment, the control unit may be configured to control transport of the medium during the warm-up operation so that an area on the medium located at a specific position when transport downstream starts is transported to a position outside of the heated area, the specific position being a position at which medium surface temperature reaches a maximum temperature while the medium being heated by the heating unit.

In the above embodiment, in the transport of the medium during the warm-up operation, the area on the medium located at a position at which a medium surface temperature reaches a maximum temperature while being heated by the heating unit is transported to a position outside of the heated area. Even if the transport toward a downstream side and the transport toward an upstream side of the medium are performed, the area on the medium temporarily moved to the outside of the heated area and radiationally cooled to a certain degree of temperature re-enters the heating area by the switching of the transport direction. This effectively prevents a partial damage to the medium due to thermal damage as well.

In a medium processing apparatus according to another embodiment, the control unit may be configured to control transport of the medium during the warm-up operation so that the area on the medium located at an upstream end portion of the heated area at a predefined timing is transported to a position downstream from the heated area.

In the above embodiment, the entire area on the medium in the heated area is temporarily moved to the outside of the heated area at a predefined timing. Accordingly, the entire area on the medium heated by the heating unit is temporarily radiationally cooled to a certain degree of temperature, further effectively preventing a damage to the medium due to thermal damage.

In another embodiment, a method of controlling a medium processing apparatus for achieving the above-described object is a method of control ling a medium processing apparatus including a heating unit configured to heat a medium and a temperature sensor configured to detect a surface temperature of the medium in a heated area, the heated area being an area heated by the heating unit, the method including: starting a warm-up operation increasing a surface temperature of the medium to a predefined temperature range by the heating unit, and causing the medium to be transported during the warm-up operation so that a downstream end portion of the medium is within a predefined range where the medium is located in a detection area of the temperature sensor. According to the above method, during the warm-up operation, the heating unit can be controlled to a suitable temperature while suppressing damage to the medium due to thermal damage.

BRIEF DESCRIPTION OF THE DRAWINGS

The invention will be described with reference to the accompanying drawings, wherein like numbers reference like elements.

DESCRIPTION OF EXEMPLARY EMBODIMENTS

One exemplary embodiment of a printing apparatus including medium processing apparatus will be described below with reference to the accompanying drawings. The printing apparatus is, for example, an ink-jet type printer configured to discharge ink, which is an example of a liquid, and to perform printing on a medium such as paper.

Figure 1:
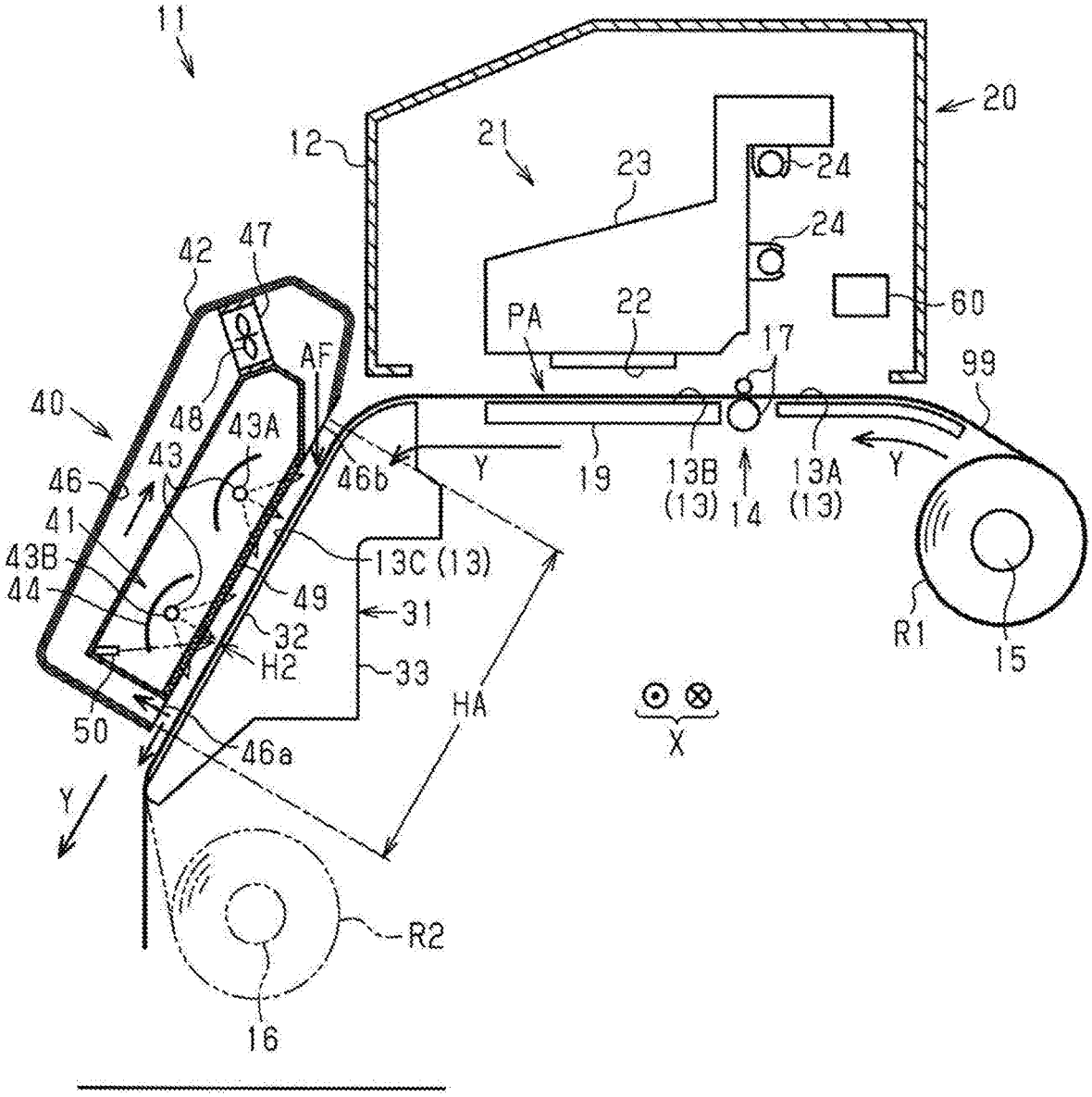
FIG. 1 is a cross-sectional side view schematically illustrating a printing apparatus including a medium processing apparatus according to one exemplary embodiment.

As illustrated in FIG. 1, a printing apparatus (medium processing apparatus) 11 includes a printing unit 20 configured to discharge liquid (e.g., ink) onto the medium 99 to perform printing on the medium 99, and a drying device 40 targeting the medium 99 on which printing has been performed by the printing unit 20. The ink handled by the printing apparatus 11 of this example is made of, for example, a dye ink or a pigment ink, and contains a liquid component capable of evaporating, for example, water or the like as a solvent or dispersion media. The printing apparatus 11 includes a support surface 13 for guidably supporting the medium 99 along a transport path, and a transport mechanism 14 as an example of a transport unit configured to transport the medium 99 along the support surface 13. The transport mechanism 14 includes a transport stage 31 for supporting the medium 99 on which printing has been performed. The transport stage 31 is disposed downstream from the printing unit 20 in a transport direction Y. The drying device 40 is disposed at a position opposing to the transport stage 31 across the transport path for the medium 99 being transported on the transport stage 31.

The printing unit 20 includes a printing mechanism 21, which is an example of the printing unit, configured to discharge liquid (e.g., ink) toward the medium 99 being transported and to perform printing on the same, and a support stage 19 (e.g., a platen) for supporting the medium 99 at a portion opposed to the printing mechanism 21, where the support stage 19 forms a horizontal portion of the support surface 13. The printing mechanism 21 is accommodated in a container 12 that opens on the opposite side to the support stage 19.

The medium 99 is, for example, an elongated roll paper. The transport mechanism 14 includes a first rotation shaft 15 for rotatably supporting a roll body R1 around which the medium 99 in an elongated shape to be printed is wound in a cylindrical shape, and a second rotation shaft 16 for supporting a roll body R2 around which the medium 99 printed is wound in a roll state. The first rotation shaft 15 is disposed at a position upstream of the transport path along which the medium 99 is transported. The second rotation shaft 16 is disposed at a position downstream of the transport path. The first rotation shaft 15 rotates driven by a feeding motor 73 (see FIG. 2) as a power source, then the transport mechanism 14 feeds out the medium 99 from the roll body R1. Further, the transport mechanism 14 rotates the second rotation shaft 16, driven by a winding motor 74 (see FIG. 2) as a power source, to wind up the medium 99 as the roll body R2.

The transport mechanism 14 includes a transport roller 17 configured to rotate in a state being in contact with the medium 99 at a position between the first rotation shaft 15 and the second rotation shaft 16 in the transport path of the medium 99. The transport roller 17 is disposed upstream from a printing area PA facing the printing mechanism 21 in the transport direction Y. The transport roller 17 is rotationally driven in accordance with the printing operation of the printing mechanism 21 using a transport motor 72 (see FIG. 2) as a power source, and transports the medium 99 in the transport direction Y.

Note that, in the exemplary embodiment, the direction along the transport path of the medium 99 being transported along the support surface 13 is referred to as "transport direction Y". Accordingly, the transport direction Y changes according to the position on the transport path, as indicated by the solid arrow in FIG. 1. For example, in the printing area PA, the transport direction Y is directed in the horizontal direction. Further, for example, in the transport area up to the area where the medium 99 is wound on the roll body R2 on a position downstream from the printing area PA, the transport direction Y is directed in an oblique direction inclined vertically downward as approaching downstream.

It is herein noted that the support surface 13 includes a first support surface 13A for supporting the medium 99 fed out from the roll body R1 disposed upstream from the transport roller 17 in the transport direction Y, a second support surface 13B for supporting the medium 99 that includes the printing area PA in the transport direction Y, disposed downstream from the transport roller 17, and a third support surface 13C for supporting the medium 99 disposed downstream from the printing area PA. The second support surface 13B coincides with the upper surface (the surface on the vertically upper side) of the support stage 19 for supporting the medium 99 disposed downstream from the transport roller 17. The third support surface 13C coincides with the upper surface of the transport stage 31 for supporting the medium 99 on which printing has been performed. The transport stage 31 is disposed in a section on the transport path between the printing area PA and the second rotation shaft 16 for supporting the roll body R2. The drying device 40 is configured to heat and dry the medium 99 on which printing has been performed, where the medium 99 is being supported by the transport stage 31.

As illustrated in FIG. 1, the printing mechanism 21 includes a print head 22 configured to discharge liquid (e.g., ink). The print head 22 prints on the medium 99 by causing the discharged liquid to adhere onto (land in) the medium 99. The printing mechanism 21, which is, for example, a serial printing method, includes a carriage 23 for holding the print head 22 and a guide shaft 24 for guiding the movement of the carriage 23. The print head 22 discharges ink while being reciprocated together with the carriage 23 in a width direction X (e.g., scanning direction) intersecting (e.g. orthogonal to) the transport direction Y of the medium 99. Then, a printing operation of moving the print head 22 in the width direction X to perform printing for one scanning and a transport operation of transporting the medium 99 to the next printing position are repeatedly performed, by which an image and the like is printed on the medium 99. Note that the printing mechanism 21 may be of a line printing type. The printing mechanism 21 of a line printing type includes the print head 22 in an elongated shape for discharging liquid in a manner that the entire width area of the medium 99 can be printed at a time. Then, the transport mechanism 14 simultaneously discharges the liquid from the print head 22 onto the medium 99 being transported at a constant speed, and prints an image and the like on the medium 99.

The drying device 40 illustrated in FIG. 1, dries by heat treatment the medium 99 to which the liquid adheres after the printing is performed by the printing unit 20. As described above, the printing apparatus 11 includes the transport stage 31 for supporting the medium 99 on which printing has been performed, where the drying device 40 heats and dries the medium 99 on which printing has been performed while being transported along the third support surface 13C (transport surface) of the transport stage 31. The transport stage 31 includes a support surface member 32 including the third support surface 13C for supporting the medium 99 on which printing has been performed, and a pair of right and left side frames 33 for supporting the support surface member 32 at both end portions of the side frames 33 (only one of the pair is illustrated in FIG. 1) in the width direction X. The support surface member 32 is supported by the pair of side frames 33 in an oblique posture illustrated in FIG. 1 where the third support surface 13C forms a downwardly inclined oblique surface that is located vertically downward as approaching downstream. The support surface member 32 is longer in the width direction X than the maximum width of the medium 99 used in the printing apparatus 11 and is longer in the transport direction Y than a heated area HA heated by the drying device 40 (see FIG. 1).

As illustrated in FIG. 1, the drying device 40 includes a heating mechanism 41, a housing 42 for housing the heating mechanism 41, an air supply passage 46 forming a passage of an airflow circulating in a path that surrounds the heating mechanism 41 in the housing 42, and an air blower 47 for generating an airflow through a path passing through the air supply passage 46. The heating mechanism 41 is disposed at a position facing the third support surface 13C and heats the medium 99 supported by the third support surface 13C. The heating mechanism 41 includes a heat generating element 43 serving as a heating source. The heat generating element 43 is formed of, for example, a heater pipe. A plurality of heat generating elements 43 (two pieces in the example of FIG. 1) are arranged at positions facing the third support surface 13C at intervals in the transport direction Y. A reflection plate 44 having a concave curved reflecting surface is disposed at a position opposite to the third support surface 13C with respect to the heat generating element 43. The heat propagated from the heat generating element 43 to the opposite side to the third support surface 13C is reflected in the most part by the reflection plate 44 toward the third support surface 13C. Thereby, most of the radiation from the heat generating element 43 is directed to the third support surface 13C. Note that, in the specification below, the heat generating element 43 located on the upstream side in the transport direction Y may be occasionally referred to as a first heat generating element 43A, while the heat generating element 43 located on the downstream side in the transport direction Y may be occasionally referred to as a second heat generating element 43B. The second heat generating element 43B is a heat generating element located on the most downstream side in the transport direction Y.

The air supply passage 46 formed in the housing 42 includes an air inlet 46*a* for intaking outside air and an air outlet 46*b* that opens toward the third support surface 13C. The heating mechanism 41 is located between the air inlet 46*a* and the air outlet 46*b* in the transport direction Y. In this example, the air inlet 46*a* is disposed at a position downstream from the heating mechanism 41 in the transport direction Y, while the air outlet 46*b* is disposed at a position upstream from the heating mechanism 41 in the transport direction Y.

The air blower 47 includes a fan 48 disposed in the air supply passage 46. The air blower 47, which is arranged in a direction (air blowing direction) to generate an airflow in the direction indicated by a solid line arrow AF in FIG. 1, flows a gas taken from the air inlet 46*a* into the air supply passage 46 toward the air outlet 46*b*. The portion of the air supply passage 46 communicating with the air outlet 46*b*, which is disposed downstream from the fan 48, is formed in a shape by which the flow path is narrowed. Further, a portion of the air supply passage 46, which is disposed downstream from the fan 48, is provided extending in a state being inclined at an angle capable of blowing an airflow in a direction obliquely downstream with respect to the third support surface 13C. Thereby, an airflow blown out from the air outlet 46*b* flows in the transport direction Y along the surface (printing surface) of the medium 99 on the third support surface 13C. Note that since the amount of air blown by the fan 48 may undesirably vary depending on the length of the drying device 40 in the width direction X, a plurality of the fans 48 may be arranged side by side in the width direction X.

The heating mechanism 41 includes a wire gauze 49 illustrated in FIG. 1 disposed in a portion ranging between the air outlet 46*b* and the air inlet 46*a* in the housing 42 and facing the third support surface 13C. The heat from the heat generating element 43 is propagated through the wire gauze 49 to the medium 99 on the third support surface 13C. Further, the wire gauze 49 guides an airflow from the air outlet 46*b* toward the air inlet 46*a* to flow along the third support surface 13C. In this way, the airflow blown out from the air outlet 46*b* flows in the transport direction Y across the heated area HA heated by the heating mechanism 41 with the heat generating element 43.

Accordingly, in the heated area HA, the evaporation of the liquid contained in the ink discharged onto the surface of the medium 99 is promoted by a radiant heat and an airflow from the heat generating element 43. Further, a vapor accumulated in a vicinity of the surface of the medium 99 forming a diffusion layer close to the saturated vapor pressure hinders the evaporation of the liquid from the medium 99. In this example, since the vapor in the vicinity of the surface of the medium 99 is blown off by the airflow, the liquid can be continuously evaporated from the medium 99. Further in the heated area HA, the support surface member 32 including the third support surface 13C is heated by the radiant heat and the airflow from the heat generating element 43. Accordingly, the medium 99 is also heated, in the heated area HA, by the heat propagated from the third support surface 13C in addition to the radiant heat and the airflow from the heat generating element 43.

Further in the drying device 40, a temperature sensor 50 for detecting the surface temperature of the medium 99 in the heated area HA (hereinafter also referred to as "medium surface temperature") is attached. The temperature sensor 50 of this example is a non-contact type sensor capable of detecting the surface temperature of an object from a position apart from the object. The temperature sensor 50 is, for example, an infrared sensor. The temperature sensor 50 is supported at a position inside of the air supply passage 46 in the housing 42 at a posture angle oriented in the arrow direction indicated by the one-dot chain line in FIG. 1. The temperature sensor 50 detects the medium surface temperature in the detection area on the medium 99. In the temperature sensor 50 of this example, the position of the maximum temperature in the temperature distribution in the transport direction Y in the heated area HA is defined as the detection area. The passage of the detection light of the temperature sensor 50 is secured through each of the openings (not depicted) formed in the reflection plate 44 and the wire gauze 49. Note that the temperature sensor 50 may be a non-contact type sensor excluding an infrared sensor.

Figure 2:
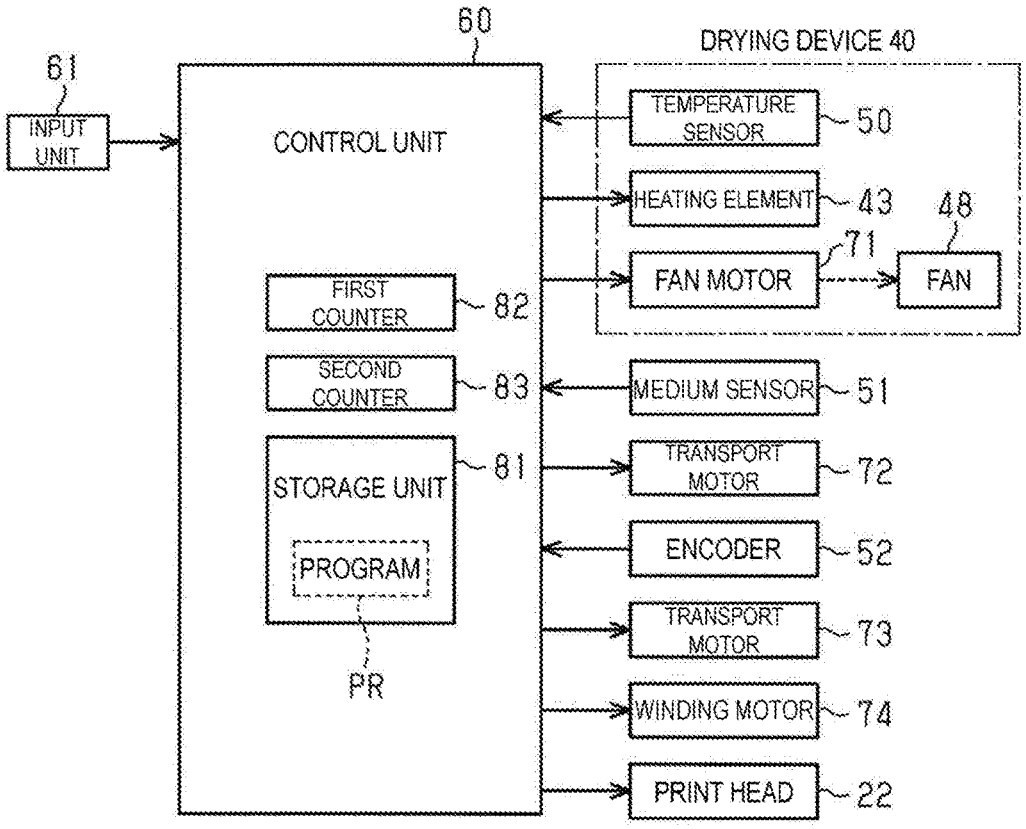
FIG. 2 is an electric block diagram illustrating an electrical configuration of a printing apparatus.
Figure 9:
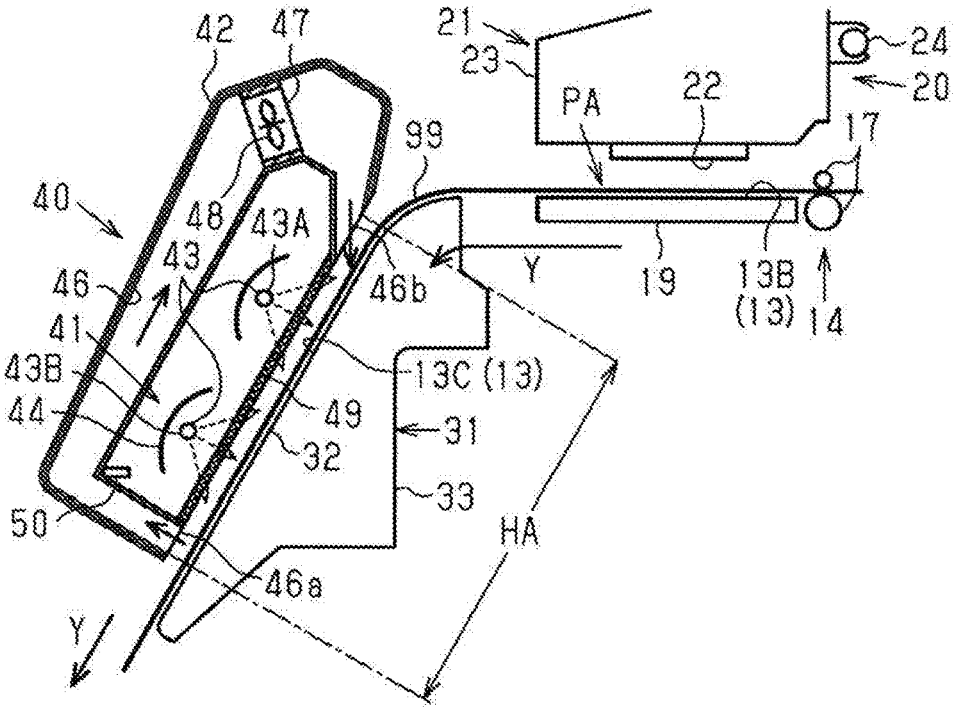
FIG. 9 is a cross-sectional side view schematically illustrating a main portion of a printing apparatus configured to perform printing process.

Next, an electrical configuration of the printing apparatus 1 will be described with reference to FIG. 9. As illustrated in FIG. 2, the printing apparatus 11 includes a control unit 60 (controller). The control unit 60 is electrically coupled with, as an input system, an input unit 61, the temperature sensor 50 capable of detecting the temperature of the drying device 40, a medium sensor 51 capable of detecting the medium 99 at a predefined position on a transport path located upstream from the printing area PA in the transport direction Y, and an encoder 52 configured to output a pulse signal including pulses the number of which proportional to the transport amount of the medium 99. The control unit 60 is input with a print job from the input unit 61, a detection signal of the temperature sensor 50, a detection signal of the medium sensor 51, and a pulse signal from the encoder 52 via an input interface (not depicted).

The control unit 60 is electrically coupled with via a plurality of drive circuits (not depicted), as an output system, the heat generating element 43, a fan motor 71 serving as a power source of the fan 48, the transport motor 72 serving as a power source of the transport roller 17, the feeding motor 73 serving as a power source of the first rotation shaft 15, the winding motor 74 serving as a power source of the second rotation shaft 16, and the print head 22. In this example in which the printing apparatus 11 is a serial printer, a carriage motor, which is a power source of the carriage 23, is electrically coupled to the control unit 60 via a drive circuit (none of which is depicted).

The control unit 60 illustrated in FIG. 2 includes a CPU, an application specific integrated circuit (ASIC), and a storage unit 81 (memory) composed of a RAM and a nonvolatile memory (none of which is depicted). The CPU executes various types of control including print control by performing a control program stored in the storage unit 81. The control program includes a program PR illustrated in FIG. 2. The program PR is for implementing a temperature adjustment sequence for performing a warm-up operation of heating the drying device 40, before the initial printing operation starts after the power of the printing apparatus 11 is turned on, until reaching a target temperature within a predefined temperature range used for drying the medium 99. The program PR includes, for example, the program illustrated in the flowchart of FIG. 10. The control unit 60 implements the temperature adjustment sequence by executing the program PR read from the storage unit 81 upon receiving an initial print command such as an initial print job from the input unit 61 after the power is turned on, Then, the control unit 60 performs a warm-up operation of increasing the output of the drying device 40, using the temperature adjustment sequence noted above, until the medium surface temperature detected by the temperature sensor 50 reaches the target temperature represented by the predefined temperature range.

The control unit 60 also includes a first counter 82 and a second counter 83 used in the temperature adjustment sequence. The first counter 82 performs counting process for acknowledging the position (transport position) on the transport path of the medium 99. In a case where a standby time is set as a condition for starting the transport of the medium 99 during the warm-up operation, the second counter 83 performs a timekeeping process for measuring the standby time.

The control unit 60 receives a print job (print command). The print job (print command) is transmitted by a user operating a host device (not depicted) coupled to the printing apparatus 11 in a wired or wirelessly communicable manner or by a user operating an operation panel (not depicted) provided in the printing apparatus 11. The print job includes various commands required for the print control, print condition information of printing conditions such as a print mode designated by the user, and print image data. The control unit 60 acknowledges the print mode based on the print condition information in the print job received from the host device.

It is herein noted that the print mode includes a high-speed print mode that gives priority to the print speed over the print quality, a high-definition print mode (low-speed print mode) that gives priority to the print quality over the print speed, and a normal print mode (medium speed print mode) in which intermediate print speed and print quality are installed. The print mode is one of the print condition information for defining the transport speed of the medium 99. The control unit 60 acquires, based on the print mode, the transport speed of the medium 99 in printing process based on the received print job.

The encoder 52 illustrated in FIG. 2 outputs a pulse signal including pulses the number of which proportional to the rotation amount of the transport motor 72, that is, the transport amount of the medium 99 being transported by the transport roller 17. The control unit 60 includes the first counter 82 for counting, for example, the number of pulse edges based on the pulse signal input from the encoder 52. The first counter 82 is reset when receiving a detection signal output from the medium sensor 51 detecting the leading end downstream of the medium 99, where the medium sensor 51 is located at the predefined position upstream from the printing area PA in the transport direction Y. The control unit 60 determines, based on pulse signals of, for example, A-phase and B-phase having different phase to each other where the pulse signals are input from the encoder 52, whether the direction (transport direction) in which the medium 99 is transported is a downstream direction (forward direction) or an upstream direction (reverse direction) in the transport direction Y in which the medium 99 is transported. Then, the control unit 60 performs a counting process in which the count value of the first counter 82 is incremented by "1" when the transport direction is the downstream direction, while the count value of the first counter 82 is decremented by "1" when the transport direction is the upstream direction. The control unit 60 acknowledges, from the count value of the first counter 82, the transport position on the transport path of the medium 99 with reference to the position (e.g., the original point) at which the leading end of the medium 99 reaches the detection position of the medium sensor 51. Note that the first counter 82, which is configured by, for example, an electronic circuit incorporated in the ASIC, may also be configured by a software.

The control unit 60 also controls the heating temperature of the heat generating element 43 by controlling a current value for energizing the heat generating element 43. The control unit 60 further controls the rotation speed of the fan motor 71. The control unit 60 further controls the rotation direction and rotation speed of each of the motors 72 to 74 of the transport system. The control unit 60 furthermore outputs the print image data included in the print job, causing the print head 22 to discharge liquid (e.g., ink) to perform printing an image and the like on the medium 99 based on the print image data.

Next, the temperature distribution in the heated area HA of the drying device 40 will be described with reference to FIG. 3. In the graph illustrated in FIG. 3, the abscissa axis indicates the transport position in the transport direction Y of the medium 99, while the ordinate axis indicates the medium surface temperature Ts. Note that, in the abscissa axis, the left direction in FIG. 3 indicates the transport direction Y.

Figure 3:
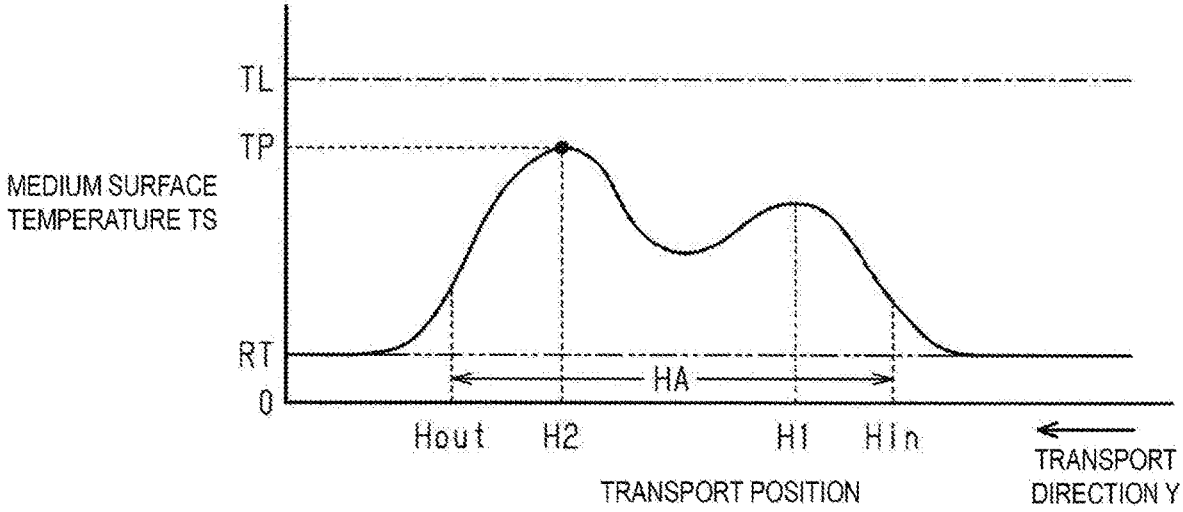
FIG. 3 is a graph illustrating a temperature distribution of a medium surface temperature in a heated area.

Also note that, in the graph illustrated in FIG. 3, a transport position H1 is a position opposing to the first heat generating element 43A, while a transport position H2 is a position opposing to the second heat generating element 43B. Further note that the upstream end position of the heated area HA is a heating start position Hin (load in position), and the downstream end position of the heated area HA is a heating end position Hout (load out position).

As illustrated in FIG. 3, the temperature distribution in the heated area HA includes two temperature peaks at two transport positions H1 and H2 opposed to the two heat generating elements 43A and 43B. The medium surface temperature Ts of the medium 99 for which heating is started from the heating start position Hin becomes the first temperature peak at the transport position H1 opposed to the first heat generating element 43A and subsequently becomes the second temperature peak at the transport position H2 opposed to the second heat generating element 43B. In the transport position H2, since the area heated by the first heat generating element 43A is further heated by the second heat generating element 43B, the second temperature peak is higher than the first temperature peak. Accordingly, the medium surface temperature Ts in the heated area HA reaches the maximum temperature at the transport position H2.

The detection area (reading position) of the temperature sensor 50 is located at the transport position H2 that is opposed to the second heat generating element 43B, where the temperature sensor 50 detects the maximum surface temperature of the medium 99 as the medium surface temperature Ts. Then, the temperature of the drying device 40 is controlled by the control unit 60, so that the medium surface temperature Ts, which is the maximum temperature, may be equal to a target temperature Tp.

In the graph illustrated in FIG. 3, an upper limit temperature TL is a limit heating temperature that causes no thermal damage to the medium 99. The target temperature Tp (maximum temperature) is set to a value that is less than the upper limit temperature TL. The target temperature Tp is set to a temperature that is lower than the upper limit temperature TL based on the upper limit temperature TL in accordance with the material of the medium 99. For example, in a case where the medium 99 is formed of paper, the upper limit temperature TL is set to a predefined value (e.g., 110° C.) within the range of from 100 to 120° C., for example, while the target temperature Tp is set to be a predefined value (e.g., 90° C.) within the range of from 80 to 100° C., for example.

The temperature increase profile of the medium surface temperature Ts when the medium 99 passes through the heated area HA depends on the transport speed of the medium 99. When the transport speed of the medium 99 differs, the medium surface temperature Ts at the detection area H2 differs even if the output of the drying device 40 falls within the same value. Accordingly, the control unit 60, regardless of the transport speed of the medium 99, can control temperature of the drying device 40 in such a manner that the medium surface temperature Ts reaches the target temperature Tp by detecting the surface temperature (the medium surface temperature Ts) of the area on the medium 99 at the detection area H2 using the temperature sensor 50. This allows the control unit 60 to equalize the medium surface temperature Ts to the target temperature Tp even if the transport speed of the medium 99 differs.

It is herein noted that, during the warm-up operation described below, a reciprocal transport of the medium 99 including a transport downstream (forward transport) and a transport upstream (reverse transport) is performed, then the identical area on the medium 99 comes to stay for a longer total duration of time in the heated area HA, and thus a partial area excluded from the detection area of the temperature sensor 50 on the medium 99 may exceed the target temperature Tp. However, if the surface temperature of the medium 99 is not higher than the upper limit temperature TL, the medium 99 may be less thermally damaged. Accordingly, even if the total duration time for the medium 99 to stay in the heated area HA during the warm-up operation becomes longer, a damage to the medium 99 due to thermal damage can be prevented as long as the surface temperature, which is detected on the leading end portion (e.g., a value in the range of 50 to 200 cm) downstream of the medium 99 used as a target of the warm-up operation, temporarily does not exceed the upper limit temperature TL. In view of the above, the range (reciprocal transport distance) for reciprocally transporting the medium 99, the total heating time, and the like are installed on the condition that the surface temperature does not exceed the upper limit temperature TL in the entire area to be heated on the medium 99. For example, the medium 99 on the surface of which thermocouples for temperature measurement are attached to a plurality of locations at different positions in the transport direction Y is transported in forward and reverse manner, by which a transport condition in which the surface temperature of the medium 99, which does not exceed the upper limit temperature TL (e.g., the reciprocal transport distance and the total heating time) at every measurement point, is determined, and then the transport control of the medium 99 is performed during the warm-up operation within the range satisfying the above determined transport condition.

The control unit 60 illustrated in FIG. 2 performs a warm-up operation of controlling temperature of the drying device 40 until the medium surface temperature Ts (detection temperature) based on the detection signal of the temperature sensor 50 reaches the target temperature and is stabilized to a value within a predefined temperature range. It is herein noted that the predefined temperature range is set to "Tp±α° C." by using an allowable value α with respect to the target temperature Tp. The control unit 60 determines that the surface temperature Ts of the medium 99 has reached the target temperature when the temperature (the medium surface temperature Ts) detected by the temperature sensor 50 stays within the predefined temperature range (Tp±α° C.) for a predefined time (e.g., a value within the range of from 2 to 20 seconds). The control unit 60 is also includes a time counter (not depicted) for measuring the predefined time.

Figure 4:
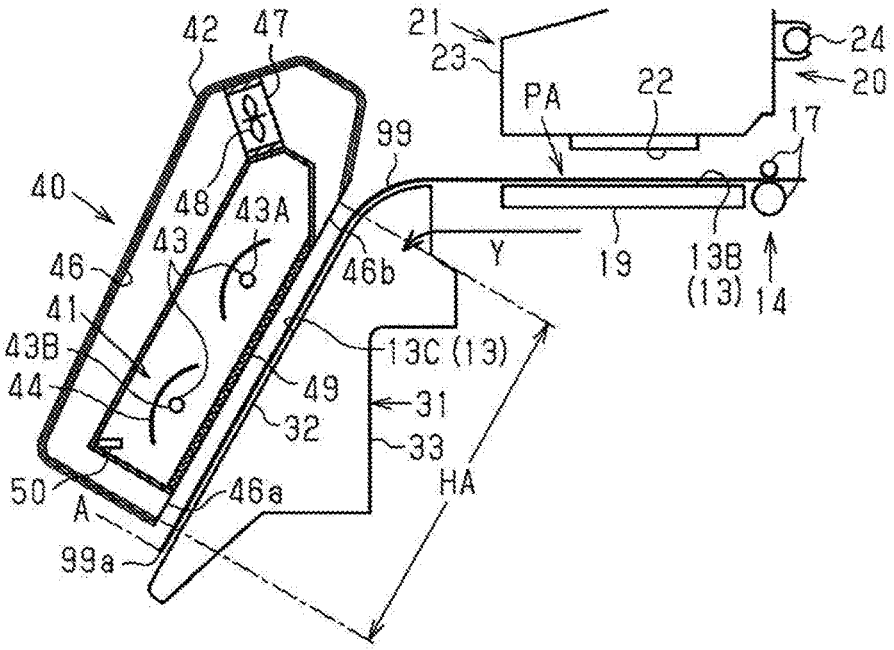
FIG. 4 is a cross-sectional side view schematically illustrating a main portion of a printing apparatus when a medium is at a set position.

Next, the warm-up operation will be described with reference to FIGS. 4 to 9. FIG. 4 illustrates a set position at which a user sets the medium 99 before printing is started. The user causes the medium 99 having been rolled out from the roll body R1 (see FIG. 1) to pass through the transport roller 17. Then, the user sets a downstream end portion 99*a* (leading end) of the medium 99 at the set position A downstream from the heated area HA of the drying device 40 by a predefined distance along the third support surface 13C of the transport stage 31. Note that the set position A is required to be a position at which the area on the medium 99 is located in the detection area of the temperature sensor 50 and the medium surface temperature Ts can be detected. For example, the set position may be set at a position between the set position A and the detection area H2 illustrated in FIG. 4. Note that a configuration in which the control unit 60 that received a print command from a user causes the medium 99 to be transported until the downstream end portion 99*a* of the medium 99 reaches the set position A allows the user to set the medium 99 in a state where the downstream end portion 99*a* of the medium 99 is located upstream from the drying device 40.

The control unit 60 starts a warm-up operation controlling the drying device 40 to increase the medium surface temperature Ts to the predefined temperature range, and controls transporting of the medium 99, during the warm-up operation, so that the downstream end portion 99*a* of the medium 99 is within a predefined range RA where the area on the medium 99 is located in the detection area H2 of the temperature sensor 50. That is, the medium 99 is transported, during the warm-up operation, within the predefined range RA (see FIG. 7) in which the downstream end portion 99*a* of the medium 99 is located downstream from the detection area H2 of the temperature sensor 50. Within the predefined range RA where the downstream end portion 99*a* of the medium 99 is located downstream from the detection area H2, the medium 99 is constantly located at the detection area H2 and is constantly detected by the temperature sensor 50.

The control unit 60 starts the warm-up operation when receiving a print command (e.g., print job) for performing printing process. The control unit 60 terminates the warm-up operation upon detecting that the medium surface temperature Ts has reached the predefined temperature range based on the detection temperature of the temperature sensor 50. The control unit 60 also causes the downstream end portion 99*a* of the medium 99 to be transported further upstream than the heated area HA, after the termination of the warm-up operation, in a state where maintaining the output of the drying device 40 within the predetermined range. Specifically, the control unit 60 causes the medium 99 to be transported upstream until the downstream end portion 99*a* reaches the print start position P1 illustrated in FIG. 8. Then, the control unit 60 controls transporting of the medium 99 until the downstream end portion 99*a* is located at the print start position P1 as an example of the predefined position upstream from the heated area HA, and then starts a printing process as an example of the predefined process.

Note that a condition (medium transport start condition) under which the transport of the medium 99 during the warm-up operation is started by the control unit 60 may be set in advance. For example, there are following two methods for setting the medium transport start condition. One is a method of setting the medium surface temperature Ts to be detected by the temperature sensor 50 as a medium transport start condition. In the above case, a specific temperature Tc that is lower than the predefined temperature range as the target temperature of the warm-up operation is set in advance, where the control unit 60 starts transporting the medium 99 during the warm-up operation when the medium surface temperature Ts is higher than or equal to the specific temperature Tc. The other is a method of setting a lapse time from the start of the warm-up operation as the medium transport start condition. In the above case, the control unit 60 starts transporting the medium 99 during the warm-up operation after a lapse of the predefined time from the start of the warm-up operation.

Further, the control unit 60 desirably performs at least a transport operation at a speed based on a print command (print job or the like) as a transport of the medium 99 during the warm-up operation. That is, in the transport of the medium 99 during the warm-up operation, one transport is favorably performed at a speed corresponding to the transport speed of the medium 99 which is applied to the printing process in the print mode designated in the print command (print job or the like). In this example, the control unit 60 controls transporting of the medium 99 at the transport speed that is equal to the transport speed in the print mode designated in the print job. Specifically, when the print mode designated in the print job is the high-speed print mode, the control unit 60 controls transporting of the medium 99 at the transport speed Vh corresponding to the high-speed print mode. Further, when the print mode designated in the print job is the normal print mode, the control unit 60 controls transporting of the medium 99 at the transport speed Vm corresponding to the normal print mode. Furthermore, when the print mode designated by the print job is the high-definition print mode, the control unit 60 controls transporting of the medium 99 at the transport speed Vl corresponding to the high-definition print mode. It is herein noted that, the transport speeds Vh, Vm, and Vl are in a magnitude relationship of Vh>Vm>Vl. Note that, although in the exemplary embodiment, an example in which three print modes are prepared and three types of transport speeds correspond to the print mode is represented, a further greater number of print modes may be prepared, and three or greater types of the transport speeds of the medium 99 may be applied to the printing process. In the above case as well, the medium 99 is transported during the warm-up operation at a speed corresponding to the transport speed in accordance with the print mode designated in the print job. Note that two or one types of the print modes may be used, and two or one types of the transport speeds of the medium 99 may be applied to the printing process.

The control unit 60 performs controls of a transport downstream (first transport) and a transport upstream side (second transport) as the transport of the medium 99 during the warm-up operation. The direction of the transport upstream is opposite to the direction of the transport downstream. That is, the control unit 60 performs a control of, during the warm-up operation, a reciprocal transport (forward and reverse transport) including a first transport (forward transport) in which the medium 99 is transported downstream and a second transport (reverse transport) in which the medium 99 is transported upstream, in a state where the downstream end portion 99*a* of the medium 99 is located within the range RA that is located downstream from the detection area H2. The control unit 60 determines whether the transport direction in which the medium 99 is transported is a downstream direction or an upstream direction, and stores the determination result of the transport direction as a value of the flag in the storage unit 81.

Figure 5:
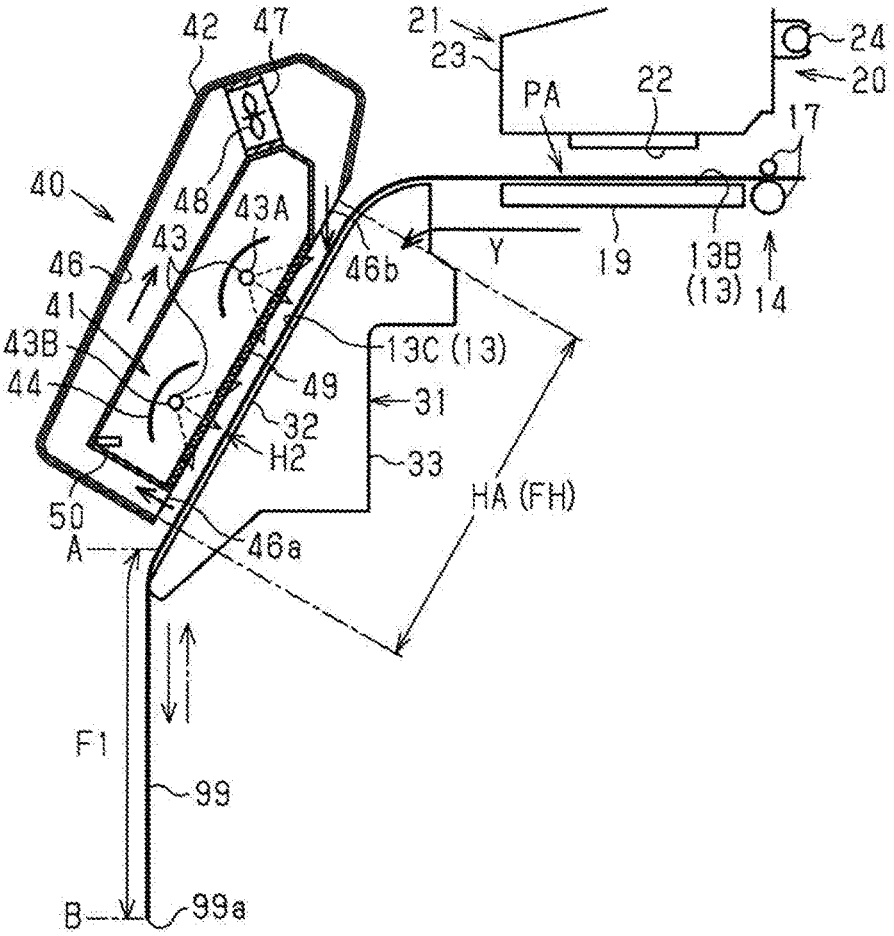
FIG. 5 is a cross-sectional side view schematically illustrating a main portion of a printing apparatus configured to perform a warm-up operation.
Figure 6:
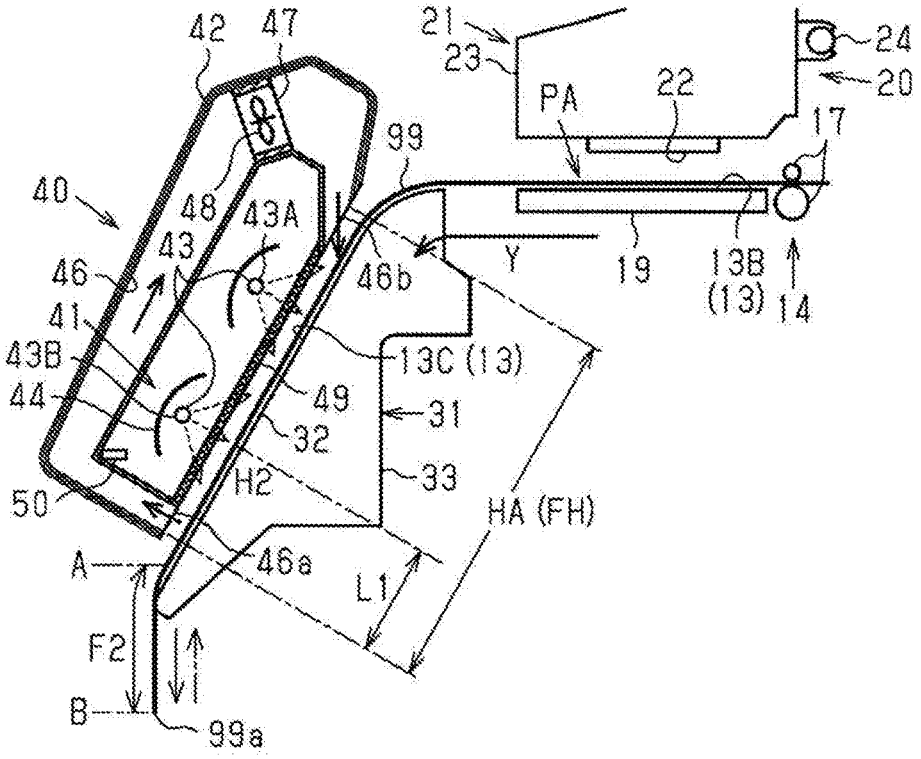
FIG. 6 is a cross-sectional side view schematically illustrating a main portion of a printing apparatus configured to perform a warm-up operation different from the operation illustrated in FIG. 5.

The reciprocal transport of the medium 99 is performed in two examples as (A) a first example illustrated in FIG. 5 and (B) a second example illustrated in FIG. 6 depending on the difference in reciprocating range of the medium 99.

Figure 7:
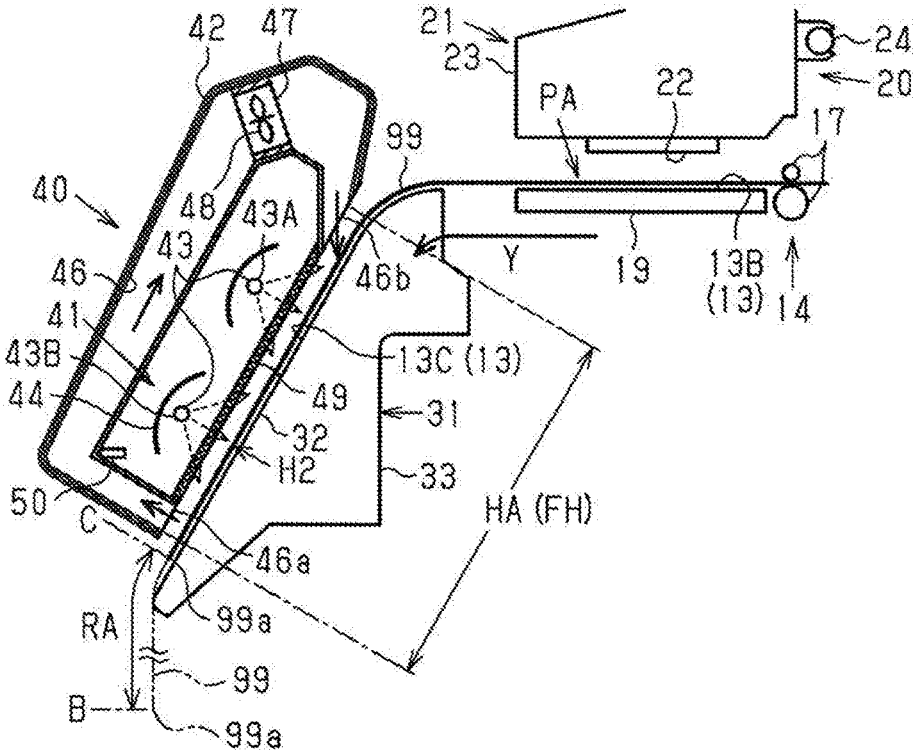
FIG. 7 is a cross-sectional side view schematically illustrating a main portion of a printing apparatus for explaining a transport upstream.

(A) The control unit 60 controls transporting of the medium 99 during the warm-up operation so that the area on the medium 99 located at the upstream end portion (e.g., the heating start position Hin) of the heated area HA at a predefined timing is transported to the position downstream from the heated area HA (i.e., the heating end position Hout) at a predefined timing. As illustrated in FIG. 5, the control unit 60 controls transporting of, at a timing when the downstream end portion 99*a* of the medium 99 is at the set position A (the transport start position during the warm-up operation), an area on the medium 99 located at the upstream side end portion of the heated area HA to a position downstream from the heated area HA. That is, as illustrated in FIG. 5, the medium 99 is transported from the state where the downstream end portion 99*a* is located at the set position A downstream from the heated area HA to the state where the downstream end portion 99*a* is located at the target position B that is the limit position downstream of the reciprocal range RA. The reciprocal range RA is downstream from the detection area H2. A transport length F1 (a length between the set position A and the target position B in the transport path), which indicates a length by which the medium 99 is transported when the downstream end portion 99*a* is moved from the set position A to the target position B, is longer than a length FH of the heated area HA in the transport direction Y (F1>FH). Thereby, the entire area on the medium 99 in the heated area HA is temporarily moved to the outside of the heated area HA when the downstream end portion 99*a* is at the set position A. Further, the length of the reciprocal range RA illustrated in FIG. 7 is longer than the length FH of the heated area HA. Accordingly, even when the medium 99 is reciprocally transported within the reciprocal range RA, the entire area on the medium 99 in the heated area HA is temporarily moved to the outside of the heated area HA at a switching timing of the transport direction of the medium 99. This is particularly effective, for example, when the temperature distribution illustrated in FIG. 3 is relatively uniform and the medium 99 being located itself in the heated area HA, which lead to a damage due to thermal damage. Note that the target position B, which is the limit position downstream of the reciprocal range RA, may favorably be set within the range where the downstream end portion 99*a* of the medium 99 avoids a contact with the floor surface.

(B) The control unit 60 controls transporting of the medium 99 during the warm-up operation so that the area on the medium 99 located at the position H2 when the transport of the medium 99 downstream starts is transported to the position outside of the heated area HA when the transport of the medium 99 downstream starts. The position H2 is a position at which the medium surface temperature Ts reaches the maximum temperature while the medium 99 being heated by the drying device 40. As illustrated in FIG. 6, the medium 99 is transported, during the warm-up operation, from the state where the downstream end portion 99*a* is located at the set position A, to the target position B as the limit position downstream of the reciprocal range RA. The reciprocal range RA is downstream from the detection area H2. A transport length F2 (a length between the set position A and the target position B in the transport path), which indicates a length by which the medium 99 is transported when the downstream end portion 99*a* is moved from the set position A to the target position B, is less than a length FH of the heated area HA in the transport direction Y (F2<FH). Further, as illustrated in FIG. 6, the transport length F2 is longer than the distance L1 between the position H2 at which the medium surface temperature Ts reaches the maximum temperature and the downstream end position (the heating end position Hout illustrated in FIG. 2) of the heated area HA (F2>L1). Thereby, the control unit 60 controls transporting of, when the transport of the medium 99 downstream starts, the area on the medium 99 located at the position H2 at which the medium surface temperature Ts reaches the maximum temperature while being heated, to the position outside of the heated area HA. Further, the length of the reciprocal range RA illustrated in FIG. 7 is longer than the distance L1 illustrated in FIG. 6. Accordingly, even when the medium 99 is reciprocally transported, the area on the medium 99 located at the position H2 at which the medium surface temperature Ts reaches the maximum temperature at a timing of switching the transport direction of the medium 99 from the upstream side to the downstream side is temporarily transported to the outside of the heated area HA. In the above case, the transport length F2 illustrated in FIG. 6 is less than the transport length F1 illustrated in FIG. 5. This is particularly effective, for example, when there is a relatively large temperature peak in the temperature distribution illustrated in FIG. 3 and the temperature difference between the minimum temperature and the maximum temperature in the heated area HA is large, and avoiding the medium 99 from only the temperature peak but the heated area HA causes avoiding a damage to the medium 99 due to thermal damage.

Further, the control unit 60 performs a control such that, in the transport of the medium 99 during the warm-up operation, a second transport speed V2 at the second transport as a transport upstream is greater than a first transport speed V1 at the first transport as a transport downstream. It is herein noted that the first transport speed V1 is a speed corresponding to the transport speed of the medium 99 during the printing process. Particularly in this example, the first transport speed V1 is equal to the transport speed of the medium 99 during the printing process, where the first transport speed V1 is equivalent to a speed corresponding to the print mode designated by the print command. Although, in this example, the second transport speed V2 is greater than the first transport speed V1, the first transport speed V1 may be equal to the second transport speed V2, and the second transport speed V2 may be less than the first transport speed V1.

Next, how the printing apparatus 11 including the drying device 40 operates will be described. First, the user turns on the power source of the printing apparatus 11. When the power source is turned on, the control unit 60 reads the program PR from the storage unit 81 and executes the program PR. The user sets the medium 99 in the printing apparatus 11, before giving an instruction to the printing apparatus 11 to print. The user sets the medium 99 in a state where the medium 99 rolled out from the roll body R1 is passed through the transport roller 17 and the heated area HA, and the downstream end portion 99*a* is located at the set position A. In the above set state, the downstream end portion 99*a* of the medium 99 is located downstream from the detection area H2 in the heated area HA, where the medium 99 is located in the detection area H2 of the temperature sensor 50. This allows the temperature sensor 50 to detect the medium surface temperature Ts even if the medium 99 is stopped at the set position A when the warm-up operation is started, After the medium 99 has been set in the manner described above, the user subsequently operates the host device or the operation panel (not depicted) to select an image data to be printed, installs necessary printing conditions, and then gives an instruction of a start of printing. The control unit 60 in the printing apparatus 11 receives a print command such as a print job from the host device, which is instructed by the user, for example.

Figure 10:
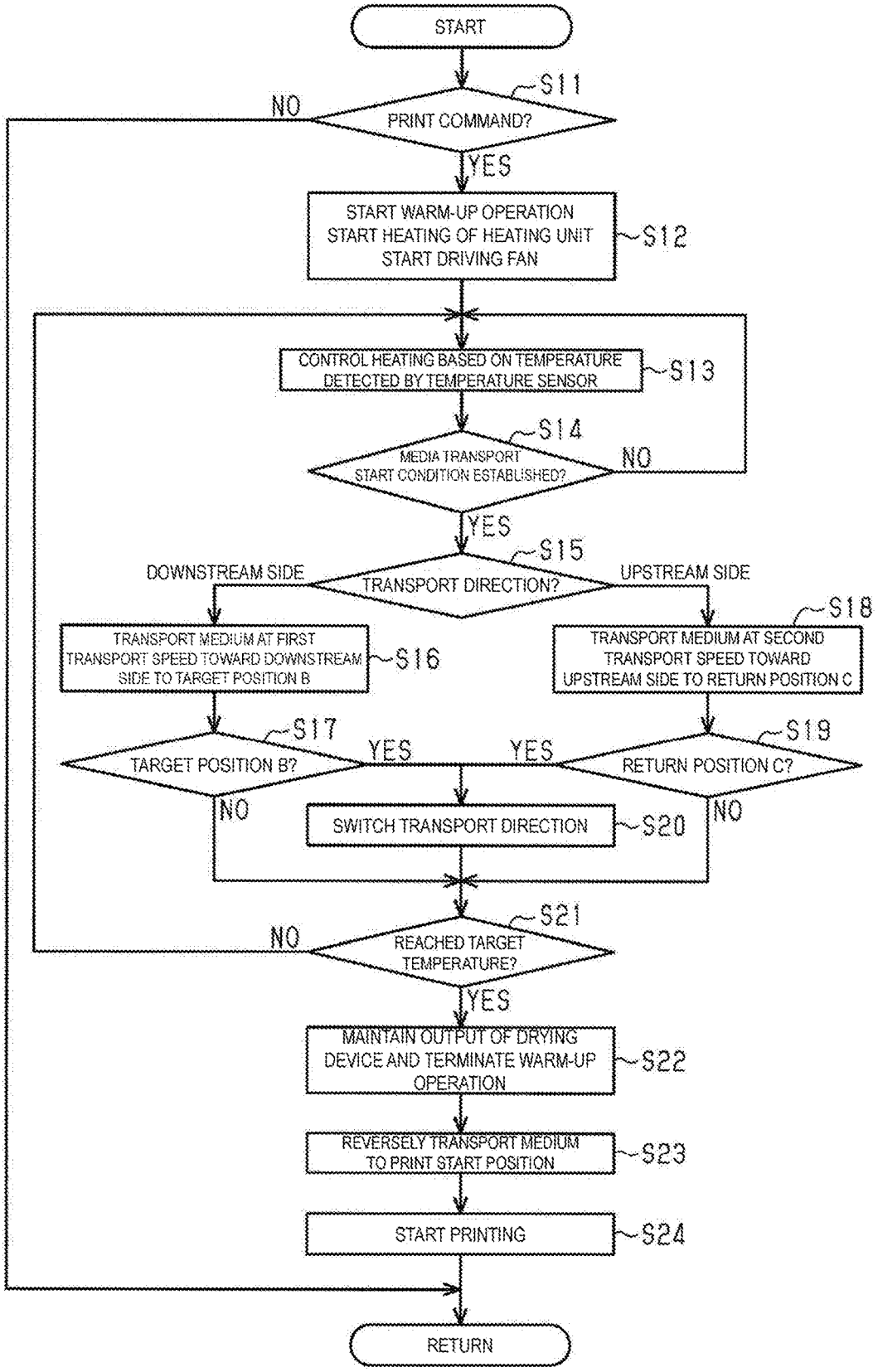
FIG. 10 is a flowchart illustrating a temperature adjustment sequence.

Hereinafter, with reference to FIG. 10, a temperature adjustment sequence executed by the control unit 60 based on the program PR will be described.

First, in step S11, the control unit 60 determines whether a print command has been received. When received the print command, the control unit 60 proceeds to step S12, while when not received the print command, the control unit 60 terminates the routine.

In step S12, the control unit 60 starts the warm-up operation. That is, the control unit 60 starts heating of the heat generating element 43 and starts driving the fan 48.

In step S13, the control unit 60 performs heating control based on the detection temperature of the temperature sensor. In the heating control, one of the following three control methods is employed. The first method is to control the rotational speed (wind speed) of the fan 48 while keeping an energizing current of the heat generating element 43 constant, the second method is to control both the energizing current of the heat generating element 43 and the rotation speed (wind speed) of the fan 48, and the third method is to control the energizing current of the heat generating element 43 while keeping the rotational speed (wind speed) of the fan 48 constant. In the heating control, the control unit 60 performs a feedback control in which the medium surface temperature Ts detected by the temperature sensor 50 is brought closer to a target value in accordance with a predetermined temperature increase profile, and controls the temperature of the medium surface temperature Ts to be increased to a predetermined temperature range ($Tp \pm \alpha°$ C.). The heating control is performed as one of the warm-up operations. For example, at the beginning of the warm-up operation in the graph illustrated in FIG. 3, since the temperature distribution in the heated area HA of the drying device 40 is obtained before heating, the temperature distribution is uniformly distributed by the room temperature RT as indicated by the two-dot chain line in the same graph. Then, in this step, the heating control is executed at every predetermined control cycle until the medium surface temperature Ts at the detection area H2 in the heated area HA reaches the predefined temperature range ($Tp \pm \alpha°$ C.) as the target temperature. In the graph of FIG. 3, the solid line represents a state where the medium surface temperature Ts at the detection area H2 reaches a predefined temperature range ($Tp \pm \alpha°$ C.) that is the target temperature.

In step S14, the control unit 60 determines whether the medium transport start condition has been established.

It is herein noted that the medium transport start condition is a condition for starting a transport of the medium 99 during the warm-up operation. The two medium transport start conditions described below, which are not necessarily required, may favorably be employed from the view point of saving electricity or the like.

The first condition is that the medium surface temperature Ts detected by the temperature sensor 50 is higher than or equal to a specific threshold value. In the control under the above condition, the control unit 60 controls transporting of the medium 99 during the warm-up operation when the medium surface temperature Ts detected by the temperature sensor 50 is higher than or equal to the specific temperature Tc. The specific temperature Tc is a temperature that is lower than the lower limit value $Tp-\alpha°$ C. of the predefined temperature range and is higher than the room temperature RT ($RT<Tc<Tp-\alpha$). Accordingly, even when the medium 99 is heated by the drying device 40, the medium 99 is not transported during the warm-up operation until the medium surface temperature Ts reaches the specific temperature Tc, and after the medium surface temperature Ts reached the specific temperature Tc, the medium 99 is transported during the warm-up operation. The control unit 60 sequentially collects the medium surface temperature Ts detected by the temperature sensor 50. Then, when the medium surface temperature Ts is lower than the specific temperature Tc, the control unit 60 determines that the medium transport start condition fails to be established, while when the medium surface temperature Ts is not lower than the specific temperature Tc, the control unit 60 determines that the medium transport start condition has been established.

The second condition is that the lapsed time from the start of the warm-up operation is not less than the predefined time. In the control under the above condition, the control unit 60 controls transporting of the medium 99 during the warm-up operation after a lapse of the predefined time from the start of the warm-up operation. The time set as the predefined time is, for example, a time estimated by a preliminary experiment or calculation for the time until the medium surface temperature Ts reaches a temperature ($Tp-\alpha-\Delta\beta$) that is lower than the lower limit temperature by a predefined temperature $\Delta\beta$. The predefined time in this example is set, for example, to a time within the range from 1 to 5 minutes. For example, the predefined time may favorably be set to a time within the range of from 10 to 80% of the time required to reach the target temperature.

Alternatively, the predefined time may be favorably set to a time required until reaching the temperature obtained by adding a predefined temperature difference within the range of from 10 to 80% of the temperature difference $\Delta T$ between the start temperature (e.g., room temperature) and the target temperature, to the start temperature. The control unit 60 measures a lapsed time from the start of the warm-up operation (e.g., the time of start of the heating) by the second counter 83. Then, when the lapsed time measured by the second counter 83 is less than the predefined time, the control unit 60 determines that the medium transport start condition fails to be established, while when the lapsed time is not less than the predefined time, the control unit 60 determines that the medium transport start condition has been established.

When the medium transport start condition fails to be established (negative determination in step S14), the control unit 60 returns to step S13, where the control unit 60 continues heating control based on the detection temperature (the medium surface temperature Ts) of the temperature sensor 50.

Then, the control unit 60 repeatedly executes the processing of step S13 until the medium transport start condition is established in step S14. Accordingly, until the medium transport start condition is established, the temperature control of the drying device 40 for increasing the medium surface temperature Ts to the target temperature proceeds to heat the area on the medium 99 located in the heated area HA while the medium 99 is stopped at the set position illustrated in FIG. 4, and thus the medium surface temperature Ts is gradually increased.

In a case when the medium surface temperature Ts detected by the temperature sensor 50 being not lower than the specific threshold value is set as the condition, the control unit 60 determines that the medium transport start condition has been established when detecting that the medium surface temperature Ts is higher than or equal to the specific temperature Tc (affirmative determination in step S14). Meanwhile, in a case when the lapsed time from the start of the warm-up operation being not less than the predefined time is set as the condition, the control unit 60 determines that the medium transport start condition has been established after a lapse of the predefined time from the start of the warm-up operation (affirmative determination in step S14). Then, when the control unit 60 determines that the medium transport start condition has been established (affirmative determination in step S14), the control unit 60 proceeds to step S15. Note that, in a case of configuration in which the medium transport start condition is not set, the step S15 is performed with the start of the warm-up operation.

In step S15, the control unit 60 determines the transport direction. The control unit 60 determines whether the transport direction is a downstream direction or an upstream direction based on the value of the flag in the storage unit 81, for example. When the transport direction is the upstream direction, the control unit 60 proceeds to step S16, while when the transport direction is the downstream direction, the control unit 60 proceeds to step S18. In this example, in the stage before the start of transport of the medium 99 during the warm-up operation, the initial value of the flag is a value (e.g., "1") indicating the downstream direction. Thus, the control unit 60 proceeds to step S16.

In step S16, the control unit 60 controls transporting of the medium 99 downstream at the first transport speed. In the exemplary embodiment, the transport speed of the medium 99 in the first transport in which the medium 99 is transported downstream is different from the transport speed of the medium 99 in the second transport in which the medium 99 is transported upstream. In a case of reciprocally transporting the downstream end portion 99*a* of the medium 99 within the range RA (see FIG. 7) located downstream from the detection area H2, the area moved to the outside downstream from the heated area HA right before the first transport as a transport downstream is switched to the second transport as a transport upstream immediately enters the heated area HA when the first transport is switched to the second transport, and re-enters the maximum temperature area. When the second transport is performed at the first transport speed V1 (the speed corresponding to the transport speed of the medium 99 during the printing process) which is a relatively low speed as in the first transport, an area excessively heated on the medium 99 may be undesirably generated. Accordingly, the second transport speed V2 during the second transport is set to a speed greater than the first transport speed V1 (V1<V2) during the first transport, where the medium 99 passes through the position H2 at the maximum temperature at a high speed.

Thus, a thermal damage to the medium 99 can be reduced due to the difference between the first transport speed and the second transport speed. Note that, in the above case, it is favorable to determine whether the medium surface temperature Ts has reached the target temperature in the process of performing the second transport (reverse transport) in which the downstream end portion 99*a* of the medium 99 is transported to the return position C at a high speed and the subsequent first transport (forward transport) in which the medium 99 is transported at the first transport speed V1 corresponding to the transport speed of the medium 99 during the printing process.

In step S17, the control unit 60 determines whether the downstream end portion 99*a* of the medium 99 has reached the target position B illustrated in FIG. 5 or FIG. 6. It is herein noted that the transport position of the medium 99 is acknowledged from the count value of the first counter 82 for counting the pulse edges of the pulse signal from the encoder 52. The control unit 60 determines whether the downstream end portion 99*a* of the medium 99 has reached the target position B based on the transport position acknowledged from the count value of the first counter 82. When the downstream end portion 99*a* has not reached the target position B, the control unit 60 proceeds to step S21, while when the downstream end portion 99*a* has reached the target position B, the control unit 60 proceeds to step S20.

Accordingly, during the first transport in which the medium 99 is transported downstream, the control unit 60 determines whether the medium surface temperature Ts has reached the target temperature in step S21. Thereafter, the control unit 60 returns to step S13 and repeatedly performs each of the processing in steps S13 to S17, and S21. In this way, the control unit 60 controls transporting of the medium 99 downstream until the medium surface temperature Ts reaches the target temperature (S21), or until the downstream end portion 99*a* of the medium 99 reaches the target position B. Then, the control unit 60 proceeds to step S20 upon determining that the downstream end portion 99*a* of the medium 99 has reached the target position B in step S17.

In step S20, the control unit 60 switches the transport direction. The control unit 60 switches the rotation of the motors 72 and 73 of the transport system from forward rotation to reverse rotation and switches the transport direction from the downstream direction to the upstream direction. At this time, the control unit 60 changes the flag in the storage unit 81 from the value of the downstream direction (e.g., "1") to the value of the upstream direction (e.g., "0").

If the medium surface temperature Ts has not reached the target temperature even though, in this way, the medium 99 has reached the target position B (negative determination in step S21), the control unit 60 returns to step S13 and continues heating control, where the medium transport start condition is being established in step S14, then the control unit 60 proceeds to step S15. Then, in step S15, since the control unit 60 determines that the transport direction is the upstream direction from the value of the flag in the storage unit 81, the control unit 60 proceeds to step S18.

In step S18, the control unit 60 controls the motors 72 and 73 to reversely transport the medium 99 upstream at the second transport speed. In this way, the control unit 60, after the transport direction is switched at the target position B illustrated in FIGS. 5 and 6, controls transporting of the medium 99 in reverse manner upstream the return position C.

In step S19, the control unit 60 determines whether the downstream end portion 99*a* of the medium 99 has reached the return position C illustrated in FIG. 7 because of the reverse transport of the medium 99. Specifically, the control unit 60 determines, based on the transport position acknowledged from the count value of the first counter 82, whether the downstream end portion 99*a* of the medium 99 has reached the return position C. When the downstream end portion 99*a* has not reached the return position C, the control unit 60 proceeds to step S21, while when the downstream end portion 99*a* has reached the return position C, the control unit 60 proceeds to step S20.

Accordingly, during the second transport in which the medium 99 is transported upstream, the control unit 60 determines whether the medium surface temperature Ts has reached the target temperature in step S21. Thereafter, the control unit 60 returns to step S13 and repeatedly performs each of the steps S13 to S15, S18, S19, and S21. In this way, the control unit 60 controls transporting of the medium 99 upstream until the medium surface temperature Ts reaches the target temperature (affirmative determination in S21) or until the downstream end portion 99*a* of the medium 99 reaches the return position C (affirmative determination in S19). Then, the control unit 60 proceeds to step S20 upon determining that the downstream end portion 99*a* of the medium 99 has reached the return position C in step S19. Note that, although in this example when a negative determination is made in step S19, the control unit 60 proceeds to step S21, the control unit 60 may be configured to determine whether the control unit 60 has reached the target temperature only in the process of the first transport (forward transport) in which the medium 99 is transported at the first transport speed V1, as described above. In the above case, when a negative determination is made in step S19, the control unit 60 returns to step S18 and continues the second transport.

In step S20, the control unit 60 switches the transport direction. The control unit 60 switches the rotation of the motors 72 and 73 of the transport system from reverse rotation to forward rotation and switches the transport direction from the upstream direction to the downstream direction. At this time, the control unit 60 changes the flag in the storage unit 81 from the value of the upstream direction (e.g., "0") to the value of the downstream direction (e.g., "1").

If the medium surface temperature Ts has not reached the target temperature even though, in this way, the medium 99 has reached the return position C (negative determination in step S21), the control unit 60 returns to step S13 and continues heating control, where the medium transport start condition is being established in step S14, then the control unit 60 proceeds to step S15. Then, in step S15, since the control unit 60 determines that the transport direction is the downstream direction from the value of the flag in the storage unit 81, the control unit 60 proceeds to step S17, where the control unit 60 controls transporting of the medium 99 downstream at the first transport speed V1 to the target position B.

In this way, the control unit 60 hereinafter repeats the first transport in which the medium 99 is transported downstream and the second transport in which the medium 99 is transported upstream in a similar manner as above. As a result, as illustrated in FIG. 7, the medium 99 is reciprocally moved in the transport direction Y within the range RA where the downstream end portion 99*a* of the medium 99 is located downstream from the detection area H2, that is, within the range between the positions B and C.

The control unit 60 continues heating control while reciprocally moving the medium 99, and then the medium surface temperature Ts is increased to reach the target temperature. The control unit 60 determines that the medium surface temperature Ts has reached the target temperature when the state where the medium surface temperature Ts is being in the predefined temperature range (Tp±α° C.) has continued for the predefined time. Then, the control unit 60 proceeds to step S22 upon determining that the medium surface temperature Ts has reached the target temperature. Note that, at this time, a temperature distribution as indicated by a solid line in FIG. 3 is formed in the heated area HA.

In step S22, the control unit 60 maintains the output of the drying device 40, and terminates the warm-up operation. That is, the control unit 60 maintains the control amount used for the temperature control of the drying device 40 at the value when the medium surface temperature Ts reached the target temperature, thereby maintaining the output of the drying device 40 within the predefined range. Examples of the control amount used by the control unit 60 include a current value for energizing the heat generating element 43 and a current command value for determining the rotation speed of the fan motor 71 that is the power source of the fan 48. The drying device 40 is maintained at the output when the medium surface temperature Ts reached the target temperature. Thus, in this example, the heat generation temperature of the heat generating element 43 and the rotation speed of the fan motor 71 are maintained. The output of the drying device 40 is thus maintained, by which the medium 99 can be heated until the medium surface temperature Ts reaches the target temperature (Tp±α° C.) when the medium 99 is thereafter transported in the heated area HA at the first transport speed V1 during the printing process.

In step S23, the control unit 60 controls transporting of the medium in reverse manner to the print start position. That is, the control unit 60 reversely drives the motors 72 and 73 of the transport system to reversely transport the medium 99.

Figure 8:
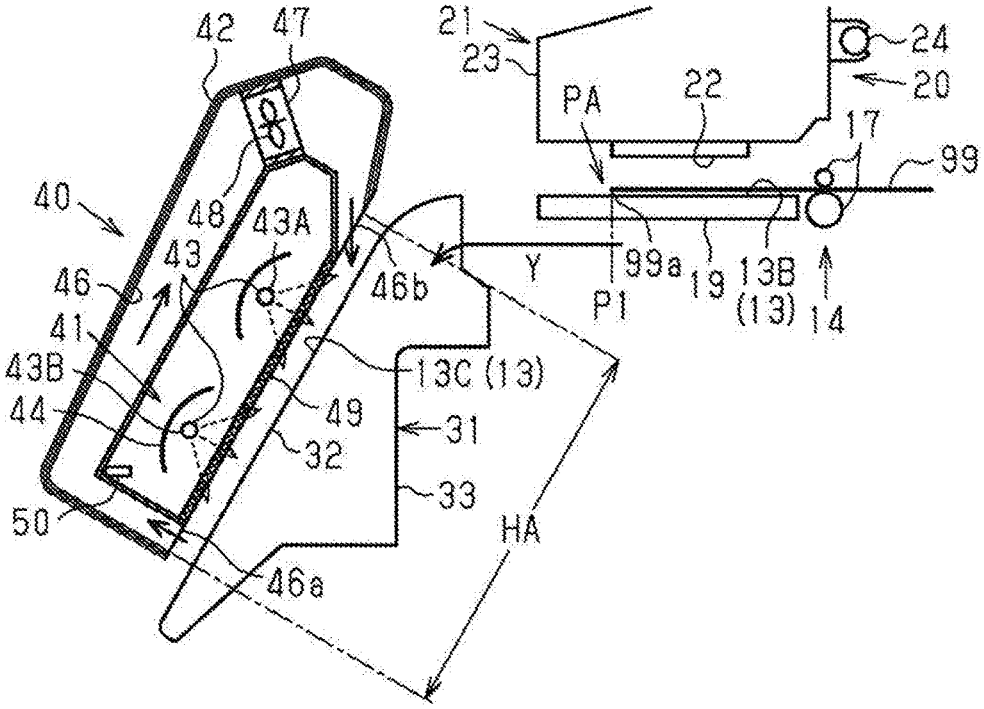
FIG. 8 is a cross-sectional side view schematically illustrating a main portion of a printing apparatus for explaining an operation after the termination of the warm-up operation.

The control unit 60 controls transporting of the medium in reverse manner until the downstream end portion 99*a* is located at the print start position P1 (cue position) illustrated in FIG. 8, and locates the downstream end portion 99*a* at the print start position P1.

In step S24, the control unit 60 starts printing. That is, the control unit 60 starts printing based on a previously received print command (e.g., print job). The print head 22 discharges a liquid onto the medium 99, by which an image and the like based on the print image data is printed on the medium 99. At this time, when the printing mechanism 21 is of the serial printing type, the printing apparatus 11 alternately performs a printing operation of one scanning and a transport operation of transporting the medium 99 to the next printing position. Then, the medium 99 is intermittently transported downstream by a predefined transport amount in the transport direction Y. The transport speed at this time is a speed (e.g., the speed V1) corresponding to the first transport speed V1 during the warm-up operation. Note that when the printing mechanism 21 is of the line printing type, the medium 99 is transported at a constant speed in accordance with the print mode. The transport speed at this time is a speed (e.g., the speed V1) corresponding to the first transport speed V1 during the warm-up operation.

Then, the medium 99 on which printing has been performed is transported along the third support surface 13C (transport surface) of the transport stage 31 at positions downstream of the printing unit 20. In the process of being transported along the third support surface 13C, the medium 99 passes through the heated area HA of the drying device 40. It is herein noted that, during the period from the termination of the warm-up operation until the medium 99 is loaded, the drying device 40 is maintained at the output when the medium surface temperature Ts reached the target temperature obtained by the warm-up operation. Accordingly, the drying device 40 is maintained at an output suitable for drying the medium 99 even if the medium 99 is reversely transported to the print start position P1 and is then removed from the detection area H2 of the temperature sensor 50, and thus the temperature sensor 50 comes to detect the area on the third support surface 13C. Thus, the medium 99 is heated until the medium surface temperature Ts reaches a predefined temperature range (Tp±α° C.) that is the target temperature or a temperature suitable for drying in the process of passing through the heated area HA of the drying device 40.

Then, the control unit 60 restarts the temperature control of the drying device 40 after the downstream end portion 99*a* of the medium 99 reached the detection area H2 of the temperature sensor 50 from the start of printing. Accordingly, during printing, the medium surface temperature Ts is maintained within a predefined temperature range (Tp±α° C.) that is the target temperature. At this time, the temperature of the drying device 40 is controlled, so that the surface temperature Ts of the medium 99 to which a liquid adheres may be maintained within a predefined temperature range (Tp±α° C.) of the target temperature.

In the heated area HA, an evaporation of the liquid (ink) adhered or permeated to the medium 99 is promoted by the radiant heat from the heat generating element 43 and the heated airflow (hot air) blown out from the air outlet 46*b*. As a result, the medium 99 is effectively dried in the process of being transported through the heated area HA. Note that, after the start of printing, the downstream end portion on which the drying of the medium 99 has ended hangs vertically downward from the downstream end side of the transport stage 31. The user wraps the downstream end portion 99*a* of the medium 9 hanging vertically downward around a core material (not depicted) attached to the second rotation shaft 16, by which the medium 99 is thereafter wound up as a roll body R2.

According to the exemplary embodiment described above, the following advantages are obtained.

(1) The printing apparatus 11 (an example of the medium processing apparatus) includes the transport mechanism 14 (an example of the transport unit) configured to transport the medium 99, the drying device 40 (an example of the heating unit) configured to heat the medium 99, the temperature sensor 50 configured to detect the surface temperature Ts of the medium 99 in the heated area HA, the heated area HA being an area heated by the drying device 40, and the control unit 60 configured to control the drying device 40 based on the medium surface temperature Ts detected by the temperature sensor 50. The control unit 60 starts the warm-up operation controlling the drying device 40 to increase the medium surface temperature Ts to the predefined temperature range, and controls transporting during the warm-up operation, the medium 99 so that the downstream end portion 99*a* of the medium 99 is within the predefined range RA where the medium 99 is located at the detection area H2 of the temperature sensor 50. That is, during the warm-up operation, the control unit 60 causes the medium 99 to be transported within the predefined range RA where the downstream end portion 99*a* of the medium 99 in the transport direction Y is located downstream from the detection area H2 of the temperature sensor 50. Accordingly, during the warm-up operation of increasing the output of the drying device 40 to a temperature suitable for heating the medium 99, the temperature of the drying device 40 can be properly controlled based on the surface temperature of the medium 99 while preventing a damage to the medium 99 used as a heating target due to thermal damage.

(2) The control unit 60 starts the warm-up operation upon receiving a print command (an example of the process command) for instructing a printing process (an example of the predefined process), terminates the warm-up operation upon detecting that the medium surface temperature Ts is increased to a predefined temperature range and starts the printing process. Accordingly, the user, by giving an instruction for the printing process, allows the control unit 60 having received the print command to start the warm-up operation. The control unit 60 terminates the warm-up operation and starts the printing process by controlling the temperature of the drying device 40 to cause the medium surface temperature Ts to reach a predefined temperature range. Accordingly, the user, by giving an instruction of the printing process, allows the printing process for the medium 99 to be started at a stage when the drying device 40 becomes ready to heat the medium surface temperature Ts to a suitable predefined temperature range.

(3) The transport of the medium 99 during the warm-up operation includes a transport of the medium 99 at a speed corresponding to the transport speed of the medium 99 during the printing process. This allows, during the warm-up operation, the medium 99 to be transported at a speed (e.g., the same speed V1) corresponding to the transport speed of the medium 99 during the printing process to be executed subsequently. Accordingly, when the printing process is performed, the medium 99 can be heated by the drying device 40 to a suitable medium surface temperature Ts. Thus, the accuracy of the medium surface temperature Ts is improved and the medium 99 can be properly dried, regardless of the transport speed of the medium 99 during the printing process, by minimizing variations in the temperature when the medium surface temperature Ts reached the predefined temperature range.

(4) The control unit 60 causes the downstream end portion 99*a* of the medium 99 to be transported further upstream than the heated area HA, after the termination of the warm-up operation, in a state where maintaining the output of the drying device 40 within the predetermined range, and starts the printing process after the transport the downstream end portion 99*a* of the medium 99 further upstream than the heated area HA is terminated. Accordingly, even if the medium 99 retreats from the detection area H2 of the temperature sensor 50 after the termination of the warm-up operation, the output of the drying device 40 is maintained within the predetermined range when the medium surface temperature Ts reached the target temperature. This prevents a malfunction due to an improper temperature control of the drying device 40, for example, due to a control in which the temperature of the drying device 40 is controlled based on the surface temperature of the third support surface 13C.

(5) The control unit 60 controls transporting of the medium 99 during the warm-up operation when the medium surface temperature Ts detected by the temperature sensor 50 is higher than or equal to the specific temperature Tc that is lower than the predefined temperature range. That is, even when the medium 99 is heated by the drying device 40, the medium 99 is not transported during the warm-up operation until the medium surface temperature Ts reaches the specific temperature Tc, while the medium 99 is transported during the warm-up operation after the medium surface temperature Ts reached the specific temperature Tc. This allows the transport amount of the medium 99 during the warm-up operation to be reduced, contributing to power saving. In the above case, a transport start timing of the medium 99 is determined based on a detection temperature (actual temperature) of the temperature sensor 50 where the detection temperature is independent of the external environment, thus, an improper transport start timing that is too early or too late can be avoided, achieving a sufficient power saving effect and a temperature control with high accuracy compared to the configuration in which the transport start timing of the medium 99 is determined by a standby time, for example. Further, for example, the medium 99 being transported is liable to float from the third support surface 13C by receiving the wind in accordance with the transport speed, where the floating of the medium 99 may cause a detection error of the medium surface temperature Ts by the temperature sensor 50. However, the medium 99 is basically held stopped in the state of being located at the detection area H2 until the medium surface temperature Ts reaches the specific temperature Tc, easily eliminating an influence of the temperature detection error due to the floating of the medium 99.

(6) The control unit 60 controls transporting of the medium 99 during the warm-up operation after a lapse of the predefined time from the start of the warm-up operation. That is, before the lapse of the predefined time from the start of the warm-up operation, the medium 99 is not transported during the warm-up operation, while after the lapse of the predefined time, the medium 99 is transported during the warm-up operation. This allows the transport amount of the medium 99 during the warm-up operation to be reduced, contributing to power saving. Further, for example, the medium 99 being transported is liable to float from the third support surface 13C by receiving the wind in accordance with the transport speed, where the floating of the medium 99 may cause a detection error of the medium surface temperature Ts by the temperature sensor 50. However, the medium 99 is basically held stopped in the state of being located at the detection area H2 until the lapse of the predefined time, easily eliminating an influence of the temperature detection error due to the floating of the medium 99.

(7) The control unit 60 performs controls of a transport downstream and a transport upstream as the transports of the medium 99 during the warm-up operation, the direction of the transport upstream being opposite to the direction of the downstream. This allows the portion to be heated by the drying device 40 in the medium 99 transported during the warm-up operation to be shortened. Further, the transport amount (e.g., cue transport amount) of the medium 99 transported upstream to the print start position P1 after the termination of the warm-up operation can be relatively shortened in more reliable manner due to the inclusion of the transport upstream. This allows the average required time from the termination of the warm-up operation to the time when the medium 99 reaches the print start position P1 and starts printing to be relatively shortened. This contributes to an improvement of the print throughput.

(8) The control unit 60 at least performs a control of the transport downstream at a speed (e.g., the speed V1) corresponding to the transport speed during the printing process. Accordingly, since the transport downstream, which is the transport direction of the medium during the printing process, is performed at the speed corresponding to the transport speed during the printing process, the temperature of the drying device 40 can be controlled to the temperature suitable for the heat treatment of the medium 99 during the printing process. Particularly in the exemplary embodiment, the second transport speed V2 at the transport upstream is greater than the first transport speed V1 at the transport downstream. Accordingly, even if an area just moved to the outside of the heated area HA in the transport of the medium 99 downstream enters the heated area HA immediately after the transport downstream is switched to the transport upstream, the medium 99 is then moved upstream at the second transport speed V2 that is greater than the first transport speed V1, preventing a damage to the area on the medium 99 due to thermal damage received by the area on the medium 99.

(9) The control unit 60 controls transporting of the medium 99 during the warm-up operation so that the area on the medium 99 located at the position H2 when the transport of the medium 99 downstream starts is transported to the position outside of the heated area HA. The position H2 is a position at which the medium surface temperature Ts reaches the maximum temperature while the medium 99 being heated by the drying device 40. Accordingly, even if the transport downstream and the transport upstream of the medium 99 are performed, the area on the medium 99 located at the position H2 at which the medium surface temperature Ts reaches the maximum temperature is temporarily moved to the outside of the heating area HA and is radiationally cooled to a certain degree of temperature, and then re-enters the heating area HA by the switching of the transport direction. This effectively prevents a partial damage to the medium 99 due to thermal damage as well.

(10) The control unit 60, in the transport of the medium 99 during the warm-up operation, controls transporting of the area on the medium 99 located at the upstream end portion of the heated area HA at a predefined timing to the position downstream of the heated area HA. Accordingly, the entire area on the medium 99 in the heated area HA is temporarily moved to the outside of the heated area HA at a predefined timing. Thus, the entire area on the medium 99 heated by the drying device 40 are temporarily radiationally cooled to a certain degree of temperature, further effectively preventing a damage to the medium 99 due to thermal damage.

(11) In the method of controlling the printing apparatus 11 (an example of the medium processing apparatus), the control unit 60 start the warm-up operation starting heating control of the drying device 40 to increase the medium surface temperature Ts to the predefined temperature range. During the above warm-up operation, the medium 99 is transported within the range RA where the downstream end portion 99*a* of the medium 99 is located downstream from the detection area H2 of the temperature sensor 50. Accordingly, during the warm-up operation, the drying device 40 can be controlled to a suitable temperature while suppressing a damage to the medium 99 due to thermal damage.

Note that the above-described exemplary embodiment may be modified as the following modified examples. Any of the configurations included in the exemplary embodiment and the configurations included in the following modified examples may be freely combined or the configurations included in the following modified examples may be freely combined to each other.

During the warm-up operation, the medium 99 may be continuously transported downstream in the transport direction Y. That is, during the warm-up operation, a configuration may be employed in which the transport toward an upstream side in the transport direction Y of the medium 99 is not performed. In the above case, the range where the downstream end portion 99*a* of the medium 99 is located downstream from the detection area H2 of the temperature sensor 50 coincides with the range where the downstream end portion 99*a* of the medium 99 is continuously transported downstream.

The first transport speed V1 may be equal to the second transport speed V2. For example, the speed may favorably be set to a speed corresponding to the transport speed of the medium 99 during the printing process, for example, the first transport speed V1 and the second transport speed V2 are both equalized to the transport speed during the printing process.

The medium 99 may be set by the user in a state where the downstream end portion 99*a* of the medium 99 is located at a position downstream by a distance corresponding to the entire length of the heated area from the heated area, and in the transport of the medium 99 during the warm-up operation, the transport of the medium 99 may be started with transport upstream. In the above case, the transport of the medium 99 during the warm-up operation may include a transport upstream and a transport downstream. In the above case, at least one of the transport upstream and the transport downstream may be desirably performed at a speed corresponding to the transport speed of the medium during the predefined process. In the above case, although the transport speed of the transport upstream may be equal to the transport speed of the transport downstream, for example, one of the first transport speed that is the speed corresponding to the transport speed of the medium during the predefined process may be set greater than the other second transport speed.

For example, a warm-up operation may be started when the user gives an instruction for a warm-up operation, without being limited to a configuration in which the warm-up operation is started with a process command such as a print command as a trigger. A warm-up operation may also be performed as one of the initial process operations with the power activation of the printing apparatus as a trigger.

The transport of the medium 99 during the warm-up operation may be constituted only by the transport of the medium 99 upstream. For example, the downstream end portion 99*a* of a medium 99 is disposed at a set position that is extended by a predefined length downstream from the heated area HA, where the medium 99 is transported upstream from the set position.

During the warm-up operation, the transport speed of the medium 99 and the corresponding speed during the predefined process are not necessarily equal to the transport speed of the medium 99 during the predefined process. The transport speed of the medium 99 during the warm-up operation may be set slightly greater than the transport speed of the medium 99 during the predefined process in view of the fact that, during the warm-up operation, the total heating time required for the medium 99 to be heated in the heated area HA until the temperature is increased to the target temperature is longer than the time required in performing the predefined process. Further, in view of the fact that during the warm-up operation, no liquid adheres to the medium 99, whereas during the printing process, a liquid adheres to the medium, the transport speed of the medium 99 during the warm-up operation may be set to a speed greater than the transport speed of the medium 99 during the printing process.

For example, a transport speed specialized to the warm-up operation may be set without being limited to a configuration in which a transport is performed at a speed corresponding to the transport speed of the medium 99 during the predefined process.

The transport of the medium 99 during the warm-up operation may be performed in a manner that the area located at a position at the maximum temperature on the medium 99 is only shifted from the detection area H2 at a predefined timing. For example, a configuration may be employed in which the area at the maximum temperature on the medium is moved to a position within the low temperature area below a predefined temperature in the temperature distribution of the heated area HA.

The heating unit may be a drying device without a mechanism for blowing a heated airflow (the air blower 47 and the air supply passage 46). For example, the heating unit may be configured to heat a medium on which printing has been performed only by radiant heat from the heat generating element. The heating unit may also be a drying device configured to blow only a heated airflow (e.g., hot air) onto a medium on which printing has been performed.

The heat generating element included in the heating unit may also be a heating wire or the like in addition to a heater tube.

The printing apparatus may also be a lateral scanning method in which the print head can move in two directions, that is, the main scanning direction and the sub scanning direction in addition to the serial printing method and the line printing method.

The medium 99 may also be a single cut sheet as long as having a certain degree of length in addition to a medium in an elongated shape such as roll paper. In the above case, the single cut sheet is required to be longer than the distance L1 in FIG. 6.

In particular, the cut sheet in the transport direction Y may favorably be longer than the length FH of the heated area HA.

The medium may also be a sheet or film made of a synthetic resin, a cloth, a foil, or the like, may also be, for example, a plastic film such as a transfer film or a thin plate or the like, or may also be a textile used for textile printing equipment or the like in addition to the paper.

The printing apparatus 11 may also be an industrial printing apparatus for manufacturing a part of an electronic component using printing technology (ink jet technology). For example, the printing mechanism 21 is used in the manufacture of liquid crystal displays, electroluminescent (EL) displays, surface emitting displays, or the like, where an electrode material or a color material (pixel material) or the like may be formed by discharging a liquid. Further, the printing apparatus may also be a three-dimensional inkjet printer for manufacturing a three-dimensional model by discharging a liquid such as a resin liquid to a base sheet (an example of the medium). A configuration may also be employed in which a three-dimensional object is formed on an underlying sheet and then the structure formed on the sheet is heated by a heating unit.

The medium processing apparatus may be, but not limited to, apparatuses including the printing unit 20. The medium processing apparatus may be used, for example, separately and alone from the apparatus including the printing unit 20. For example, a configuration may be employed in which the medium processing apparatus is disposed at a position downstream from an apparatus including the printing unit 20, where the medium 99 exhausted from the apparatus including the printing unit 20 is received and the medium thus received is dried. Further, a medium processing apparatus may be employed in which the medium 99 is dried to which a liquid adheres by discharging, coating, spraying, transferring, dipping, or the like for the purpose other than printing. The purposes other than printing include the formation of a coating layer on the surface of the medium (including coating; coating film formation), coloring of the medium, impregnation of a treatment liquid or treatment material (e.g. particles) on the medium, recreation of the medium, and the like. In this way, the medium processing apparatus may be used for a heat treatment (including drying) of a medium other than printed material.

The predefined process may be, but not limited to, the printing process. The predefined process, which is, for example, a process of blowing a liquid such as water onto the surface of the medium, may be a process in which wrinkles of the medium is extended by heating and drying the medium onto which a liquid has been sprayed with a drying device. Further, the predefined process, which is a process of attaching a thermosetting resin liquid to the surface of the medium, may be a process in which a medium to which a thermosetting resin liquid has adhered is heated with a heating device (an example of the heating unit) and the thermosetting resin adhering on the medium is thermally hardened. Note that the temperature sensor may be of a contact type configured to make a contact with the surface of the medium to detect the surface temperature as long as being a predefined process not causing an issue even when being in contact with the processed surface after the predefined process is performed on the medium.

This application claims priority under 35 U.S.C. § 119 to Japanese Patent Application No. 2017-232755, filed Dec. 4, 2017. The entire disclosure of Japanese Patent Application No. 2017-232755 is hereby incorporated herein by reference.

What is claimed is:

1. A medium processing apparatus comprising:

a transport unit configured to transport a medium;

a heating unit configured to heat the medium;

a temperature sensor configured to detect a surface temperature of the medium in a heated area, the heated area being an area heated by the heating unit; and a control unit configured to control the heating unit based on the surface temperature detected by the temperature sensor, wherein the control unit is configured to start a warm-up operation controlling the heating unit to increase the surface temperature of the medium to a predefined temperature range, and to control transport of the medium during the warm-up operation so that a downstream end portion of the medium is within a predefined range where the medium is located in a detection area of the temperature sensor, and wherein the control unit is configured to control transport downstream and transport upstream as transport of the medium during the warm-up operation such that the medium is transported in a downstream direction and an upstream direction, the direction of the transport upstream being opposite to the direction of the transport downstream.

2. The medium processing apparatus according to claim 1, wherein the control unit is configured to start the warm-up operation upon receiving a process command for instructing a predefined process, to terminate the warm-up operation upon detecting that the surface temperature of the medium is increased to the predefined temperature range, and to start the predefined process.

3. The medium processing apparatus according to claim 2, wherein transport of the medium during the warm-up operation includes transport of the medium at speed corresponding to a transport speed of the medium during the predefined process.

4. The medium processing apparatus according to claim 2, wherein the control unit is configured to cause the downstream end portion of the medium to be transported further upstream than the heated area, after termination of the warm-up operation, in a state where maintaining an output of the heating unit within a predetermined range, and to start the predefined process after the transport of the downstream end portion of the medium further upstream than the heated area is terminated.

5. The medium processing apparatus according to claim 1, wherein the control unit is configured to control transport of the medium during the warm-up operation when surface temperature of the medium detected by the temperature sensor is higher than or equal to a specific temperature, the specific temperature being lower than the predefined temperature range.

6. The medium processing apparatus according to claim 1, wherein the control unit is configured to control transport of the medium during the warm-up operation after a lapse of a predefined time from the start of the warm-up operation.

7. The medium processing apparatus according to claim 1, wherein second transport speed at the transport downstream is greater than first transport speed at the transport upstream.

8. The medium processing apparatus according to claim 1, wherein the control unit is configured to control transport of the medium during the warm-up operation so that an area on the medium located at a specific position when transport downstream starts is transported to a position outside of the heated area, the specific position being a position at which a medium surface temperature reaches a maximum temperature while the medium is being heated by the heating unit.

9. The medium processing apparatus according to claim 1, wherein the control unit is configured to control transport of the medium during the warm-up operation so that an area on the medium located at an upstream end portion of the heated area at a predefined timing is transported to a position downstream from the heated area.

10. A method of controlling a medium processing apparatus, the medium processing apparatus including a heating unit configured to heat a medium, and a temperature sensor configured to detect a surface temperature of the medium in a heated area, the heated area being an area heated by the heating unit, the method comprising:

starting a warm-up operation increasing a surface temperature of the medium to a predefined temperature range by the heating unit, causing the medium to be transported during the warm-up operation so that a downstream end portion of the medium is within a predefined range where the medium is located in a detection area of the temperature sensor, and controlling transport downstream and transport upstream as transport of the medium during the warm-up operation such that the medium is transported in a downstream direction and an upstream direction, the direction of the transport upstream being opposite to the direction of the transport downstream.

* * * * *